US006658371B2

(12) United States Patent
Boehm et al.

(10) Patent No.: US 6,658,371 B2
(45) **Date of Patent: *Dec. 2, 2003**

(54) METHOD FOR MATCHING GOLFERS WITH A DRIVER AND BALL

(75) Inventors: Herbert C. Boehm, Norwell, MA (US); Laurent Bissonnette, Portsmouth, RI (US); Jeffrey L. Dalton, North Dartmouth, MA (US); Steven Aoyama, Marion, MA (US)

(73) Assignee: Acushnet Company, Fairhaven, MA (US)

( * ) Notice: Subject to any disclaimer, the term of this patent is extended or adjusted under 35 U.S.C. 154(b) by 3 days.

This patent is subject to a terminal disclaimer.

(21) Appl. No.: 10/370,721

(22) Filed: Feb. 24, 2003

(65) Prior Publication Data

US 2003/0176988 A1 Sep. 18, 2003

Related U.S. Application Data

(60) Continuation-in-part of application No. 10/259,731, filed on Sep. 30, 2002, which is a continuation-in-part of application No. 10/122,334, filed on Apr. 16, 2002, now Pat. No. 6,490,542, which is a continuation-in-part of application No. 09/775,543, filed on Feb. 5, 2001, now Pat. No. 6,385,559, which is a continuation-in-part of application No. 09/316,365, filed on May 21, 1999, now Pat. No. 6,192,323, application No. 10/370,721, which is a continuation-in-part of application No. 10/096,852, filed on Mar. 14, 2002, which is a continuation-in-part of application No. 09/989,191, filed on Nov. 21, 2001, and a continuation-in-part of application No. 09/404,164, filed on Sep. 27, 1999, now Pat. No. 6,358,161, which is a division of application No. 08/922,633, filed on Sep. 3, 1997, now Pat. No. 5,957,786.

(51) Int. Cl.[7] ..... A63B 37/14; G06F 11/30

(52) U.S. Cl. ..... 702/182; 702/127; 473/223; 473/383; 473/384

(58) Field of Search ..... 702/127, 141, 702/182; 473/384, 252, 223, 377–383; 73/379; 482/112, 118; 273/232; 264/219

(56) References Cited

U.S. PATENT DOCUMENTS

| | | | | |
|---|---|---|---|---|
| 4,063,259 | A | 12/1977 | Lynch et al. | 354/120 |
| 4,136,387 | A | 1/1979 | Sullivan et al. | 364/410 |
| 4,137,566 | A | 1/1979 | Haas et al. | 364/410 |
| 4,158,853 | A | 6/1979 | Sullivan et al. | 358/93 |
| 4,375,887 | A | 3/1983 | Lynch et al. | 273/32 H |
| 4,560,168 | A | 12/1985 | Aoyama | 273/232 |
| 4,729,861 | A | 3/1988 | Lynch et al. | 264/219 |
| 4,915,390 | A | 4/1990 | Gobush et al. | 273/232 |
| 4,925,195 | A | 5/1990 | Melvin et al. | 273/232 |
| 4,991,852 | A | 2/1991 | Pattison | 273/232 |

(List continued on next page.)

OTHER PUBLICATIONS

U.S. Patent Publication No. 2002/0123395.
U.S. Patent Publication No. 2002/0123390.
U.S. Patent Publication No. 2001/0009310.
U.S. Patent Application Ser. No. 09/551,771 filed Apr. 18 2000 entitled "Golf Club Head With A High Coefficient Restitution".

(List continued on next page.)

*Primary Examiner*—Kamini Shah
(74) *Attorney, Agent, or Firm*—Swidler Berlin Shereff Friedman, LLP

(57) ABSTRACT

A simplified method of matching a golfer to a golf club and a golf ball by measuring the golfer's club head speed and comparing that measured value to recorded sets of data which correlates a few key variables that can accurately match the golfer with the most suitable golf club and golf ball designed to achieve optimum driving performance.

18 Claims, 28 Drawing Sheets

U.S. PATENT DOCUMENTS

| | | | | | |
|---|---|---|---|---|---|
| 5,018,741 | A | | 5/1991 | Stiefel et al. | 273/232 |
| D318,507 | S | | 7/1991 | Gobush et al. | D21/205 |
| D318,508 | S | | 7/1991 | Gobush et al. | D21/205 |
| D320,829 | S | | 10/1991 | Gobush et al. | D21/205 |
| D321,231 | S | | 10/1991 | Gobush et al. | D21/205 |
| 5,060,954 | A | | 10/1991 | Gobush | 473/378 |
| 5,092,604 | A | | 3/1992 | Oka | 473/384 |
| D327,519 | S | | 6/1992 | Gobush et al. | D21/205 |
| D336,755 | S | | 6/1993 | Pelletier | D21/205 |
| D340,488 | S | | 10/1993 | Aoyama | D21/205 |
| 5,249,804 | A | | 10/1993 | Sanchez | 273/232 |
| 5,273,287 | A | | 12/1993 | Molitor et al. | 473/384 |
| D349,141 | S | | 7/1994 | Pelletier et al. | D21/205 |
| D359,993 | S | | 7/1995 | Pelletier et al. | D21/205 |
| D364,904 | S | | 12/1995 | Pelletier et al. | D21/205 |
| 5,486,002 | A | * | 1/1996 | Witler | 473/199 |
| 5,562,552 | A | | 10/1996 | Thurman | 473/379 |
| 5,575,477 | A | | 11/1996 | Hwang | 473/379 |
| 5,586,951 | A | | 12/1996 | Sugiura | 473/379 |
| 5,682,230 | A | | 10/1997 | Anfinsen et al. | 356/28 |
| 5,688,191 | A | | 11/1997 | Cavallaro et al. | 473/373 |
| 5,694,340 | A | * | 12/1997 | Kim | 702/141 |
| 5,702,312 | A | | 12/1997 | Horiuchi et al. | 473/77 |
| 5,713,801 | A | | 2/1998 | Aoyama | 473/354 |
| 5,803,831 | A | | 9/1998 | Sullivan et al. | 473/374 |
| 5,846,141 | A | | 12/1998 | Morgan et al. | 473/354 |
| 5,885,172 | A | | 3/1999 | Hebert et al. | 473/354 |
| 5,919,100 | A | | 7/1999 | Boehm et al. | 473/354 |
| 5,935,023 | A | | 8/1999 | Maehara et al. | 473/384 |
| 5,957,786 | A | * | 9/1999 | Aoyama | 473/379 |
| 5,957,787 | A | | 9/1999 | Hwang | 473/379 |
| 5,965,669 | A | | 10/1999 | Cavallaro et al. | 525/221 |
| 5,981,654 | A | | 11/1999 | Rajagopalan | 525/66 |
| 5,981,658 | A | | 11/1999 | Rajagopalan et al. | 525/72 |
| 6,124,389 | A | | 9/2000 | Cavallaro et al. | 524/432 |
| 6,149,535 | A | | 11/2000 | Bissonnette et al. | 473/354 |
| 6,186,002 | B1 | | 2/2001 | Lieberman et al. | 73/432.1 |
| 6,213,898 | B1 | | 4/2001 | Ogg | 473/383 |
| 6,285,445 | B1 | | 9/2001 | Winfield et al. | 356/28 |
| 6,290,615 | B1 | | 9/2001 | Ogg | 473/378 |
| 6,331,150 | B1 | | 12/2001 | Ogg | 473/383 |
| 6,338,684 | B1 | | 1/2002 | Winfield et al. | 473/378 |
| 6,354,966 | B1 | | 3/2002 | Takemura et al. | 473/370 |
| 6,358,161 | B1 | * | 3/2002 | Aoyama | 473/383 |
| 6,490,542 | B2 | | 12/2002 | Boehm | 702/182 |

OTHER PUBLICATIONS

U.S. Patent Application Ser. No. 09/995,124 filed Sep. 19, 2001 entitled "Apparatus and Method For Measurement Of Coefficient Of Restitution And Contact Time".

Science Eye: A System for Computer Age Golf Clinics and Custom Golf Club Fitting, Bridgestone Corp., Tokyo, Japan, 6 pages (undated).

DeadSolid Golf brochure, DeadSolid Simulations, Inc., Pittston, PA, 12 pages (undated).

Par T Golf Double Eagle 2000 brochure, Par T Golf Marketing Co., Las Vegas, NV, 6 pages (undated).

Golf Digest Special Editorial Report, 7 pages (Oct. 1980).

Golf Club Design, Fitting, Alteration and Repair: The Principles and Procedures, Ralph Maltby, cover sheet, pp. 310–324 and pp. 481–494 (May 1982).

Maltby, R., *The Golf Works*, "The Complete Golf Club Fitting Plan", Ralph Maltby Enterprises, Inc., Newark, OH, 26 pages (May 1986).

Top–Flite Golf Ball Ad, 1 page (1998).

GolfTek brochure, GolfTek, Lewiston, ID, 6 pages (1998).

* cited by examiner $D_A < D_B \leqslant D_C \leqslant D_D \leqslant D_E$

80% $D_A$, $D_B$, $D_C$, $D_D$, $D_E$ >0.11"

DIMP. AREA > 80%

$$D_A < D_B \leq D_C \leq D_D \leq D_E$$

METHOD FOR MATCHING GOLFERS WITH A DRIVER AND BALL

CROSS-REFERENCE TO RELATED APPLICATIONS

This application is a continuation-in-part of U.S. patent application Ser. No. 10/259,731, filed Sep. 30, 2002, now pending, which is a continuation-in-part of U.S. patent application Ser. No. 10/122,334, filed Apr. 16, 2002, now allowed U.S. Pat. No. 6,490,542, which is a continuation-in-part of U.S. patent application Ser. No. 09/775,543, filed Feb. 5, 2001, now U.S. Pat. No. 6,385,559, which is a continuation-in-part of U.S. patent application Ser. No. 09/316,365, filed May 21, 1999, now U.S. Pat. No. 6,192,323. This application is also a continuation-in part of U.S. Pat. No. 10/096,852, filed Mar. 14, 2002, now pending, which is a continuation-in-part of U.S. patent application Ser. No. 09/989,191, filed Nov. 21, 2001, now pending, and also a continuation-in-part of U.S. patent application Ser. No. 09/404,164, filed Sep. 27, 1999, now U.S. Pat. No. 6,358,161, which is a divisional of U.S. patent application Ser. No. 08/922,633, filed Sep. 3, 1997, now U.S. Pat. No. 5,957,786. The entire disclosures of the related applications are incorporated by reference herein.

FIELD OF THE INVENTION

The present invention generally relates to methods for custom fitting a golfer with golfing equipment suited to that golfer's individual swing characteristics. More specifically, the present invention relates to a simplified method of matching a golfer with a particular driver and golf ball designed to achieve maximum driving distance.

BACKGROUND OF THE INVENTION

Methods of custom fitting a golfer to the most suitable golf ball, taking into account different swing characteristics, are well known within the golf industry. For example, the testing laboratory at the Acushnet Golf Center in New Bedford, Mass. has been measuring and analyzing the swing characteristics and ball launch conditions of thousands of golfers since the early seventies, as described in a special editorial report in the October 1980 issue of Golf Digest. As a result of this testing, Acushnet has developed an accurate method of matching a golfer with particularized golfing equipment. This method utilizes sophisticated equipment that, while the golfer hits a variety of drivers (or number 1 clubs) having variations in head and shaft characteristics and golf balls of different construction and performance characteristics, measure the ball's launch conditions. Cameras monitor the golfer's launch conditions by tracking the movement of a cluster of light emitting diodes attached to specific locations on the golf ball. Each camera has strobe lights that emit light immediately after the golf ball is struck. The light reflects off the diodes and is captured by the camera and sent to a computer for processing. This data is then recorded and analyzed using complex mathematical models which are able to calculate, among other things, the distance that a golf ball travels when struck off the tee by the golfer. From this information, the most appropriate golf club or golf ball is then selected for that specific golfer. Although this methodology very accurately matches a golfer to a golf club and a golf ball, it requires the use of electronic measuring equipment not always readily available. Consequently, the custom club fitting industry has, in recent years, attempted to meet the need for simpler custom golf club fitting methods.

For example, Spalding has developed the Ball/Club System C and System T which matches Top-Flite golf balls with Callaway's Great Big Bertha and Taylor Made's TI Bubble 2 drivers. These balls were allegedly designed by matching the golf ball to the launch angle, speed and spin for use with the specific drivers. However, the Spalding system fails to consider key variables such as the golfer's swing speed, club loft angles and shaft flex. Therefore, under this system a pro golfer and a beginner using any Callaway club is directed to the same ball. Similarly, Dunlop/Maxfli has proposed a method which matches a players swing speed to a particular ball compression. However, this method fails again to consider the design of the club head and the club shaft. Consequently, neither of these methods adequately meets the demand for a simple, yet accurate, club fitting method.

Thus, there remains a need in the art for a reliable method to custom fit a golfer with golfing equipment suited to that golfer's individual swing characteristics, and in particular match a golfer with a particular driver and a particular golf ball to achieve maximum driving distance.

SUMMARY OF THE INVENTION

The present invention is directed to a method for matching a golfer to a golf ball and a golf club including the steps of: measuring at least one parameter for the golfer at impact with a ball, wherein the at least one parameter includes club head speed, ball speed, or a combination thereof, comparing the measured parameter to a predetermined set of variables, wherein the set of variables include:

golf club loft angle;

golf club coefficient of restitution;

golf ball dimple count; and golf ball dimple diameter;

selecting at least one golf club and at least one golf ball in accordance with the comparison of the club head speed to the set of variables to obtain optimum driving performance.

In one embodiment, the measured parameter is correlated to the golf club loft angle based on a linear relationship. In another embodiment, the measured parameter is correlated to the golf club coefficient of restitution based on a linear relationship. In yet another embodiment, the measured parameter is correlated to the dimple count based on a linear relationship. In still another embodiment, the measured parameter is correlated to the golf ball dimple diameter based on a linear relationship.

The club head speed preferably includes high speed, medium speed, and low speed, wherein high speed is about 80 miles per hour or greater, wherein the medium speed about 60 miles per hour to about 80 miles per hour and the low speed is about 60 miles per hour or less. In addition, the ball speed preferably includes high speed, medium speed, and low speed, wherein high speed is about 146 miles per hour or greater, wherein the medium speed is about 144 miles per hour to about 125 miles per hour, and wherein the low ball speed is about 124 miles per hour or less.

The set of variables may also include average golf club face thickness, golf club shaft flex, ball weight, ball spin rate, ball compression, lift coefficient, or drag coefficient, wherein the lift coefficient and drag coefficient are measured at a Reynold's number of 70,000.

The present invention is also directed to a method for matching a golfer to a golf ball including a plurality of dimples and a golf club including the steps of: measuring at least one golfer parameter, wherein the at least one parameter includes swing speed or ball speed; comparing the measured parameter to at least one predetermined club characteristic including club coefficient of restitution, loft angle, shaft flex, or club face thickness and at least one predetermined ball characteristic including dimple count, average dimple diameter, ball coefficient of restitution, spin rate, compression, golf ball lift coefficient, or golf ball drag coefficient; and matching the golfer to at least one golf club and at least one golf ball in accordance with the comparison of the measured parameter to the at least one predetermined club characteristic or the at least one predetermined ball characteristic to obtain optimum driving performance. The lift and drag coefficients are preferably measured at a Reynold's Number of 70,000.

In one embodiment, the measured parameter is correlated to the at least one predetermined club characteristic based on a linear relationship. In another embodiment, the measured parameter is correlated to the at least one predetermined ball characteristic based on a linear relationship.

In yet another embodiment, the ball speed includes high speed, medium speed, and low speed. The high speed is preferably about 146 miles per hour or greater, the medium speed is preferably about 144 miles per hour to about 125 miles per hour, and the low speed is preferably about 124 miles per hour or less.

In this aspect of the invention, the plurality of dimples preferably cover about 80 percent or greater of the ball surface. In one embodiment, at least about 80 percent of the plurality of dimples have a diameter greater than about 6.5 percent of the ball diameter, and wherein the dimples are arranged in an icosahedron or an octahedron pattern. In another embodiment, the plurality of dimples preferably includes at least three different dimple diameters. In still another embodiment, at least 10 percent of the dimples have a shape defined by catenary curve.

The plurality of dimples may also have an aerodynamic coefficient magnitude defined by $C_{mag}=\sqrt{(C_L^2+C_D^2)}$ and an aerodynamic force angle defined by $\text{Angle}=\tan^{-1}(C_L/C_D)$, wherein $C_L$ is the golf ball lift coefficient and $C_D$ is the golf ball drag coefficient, wherein the golf ball includes: a first aerodynamic coefficient magnitude from about 0.24 to about 0.27 and a first aerodynamic force angle of about 31 degrees to about 35 degrees at a Reynolds Number of about 230000 and a spin ratio of about 0.085; and a second aerodynamic coefficient magnitude from about 0.25 to about 0.28 and a second aerodynamic force angle of about 34 degrees to about 38 degrees at a Reynolds Number of about 207000 and a spin ratio of about 0.095.

DETAILED DESCRIPTION OF THE INVENTION

Figure 1:
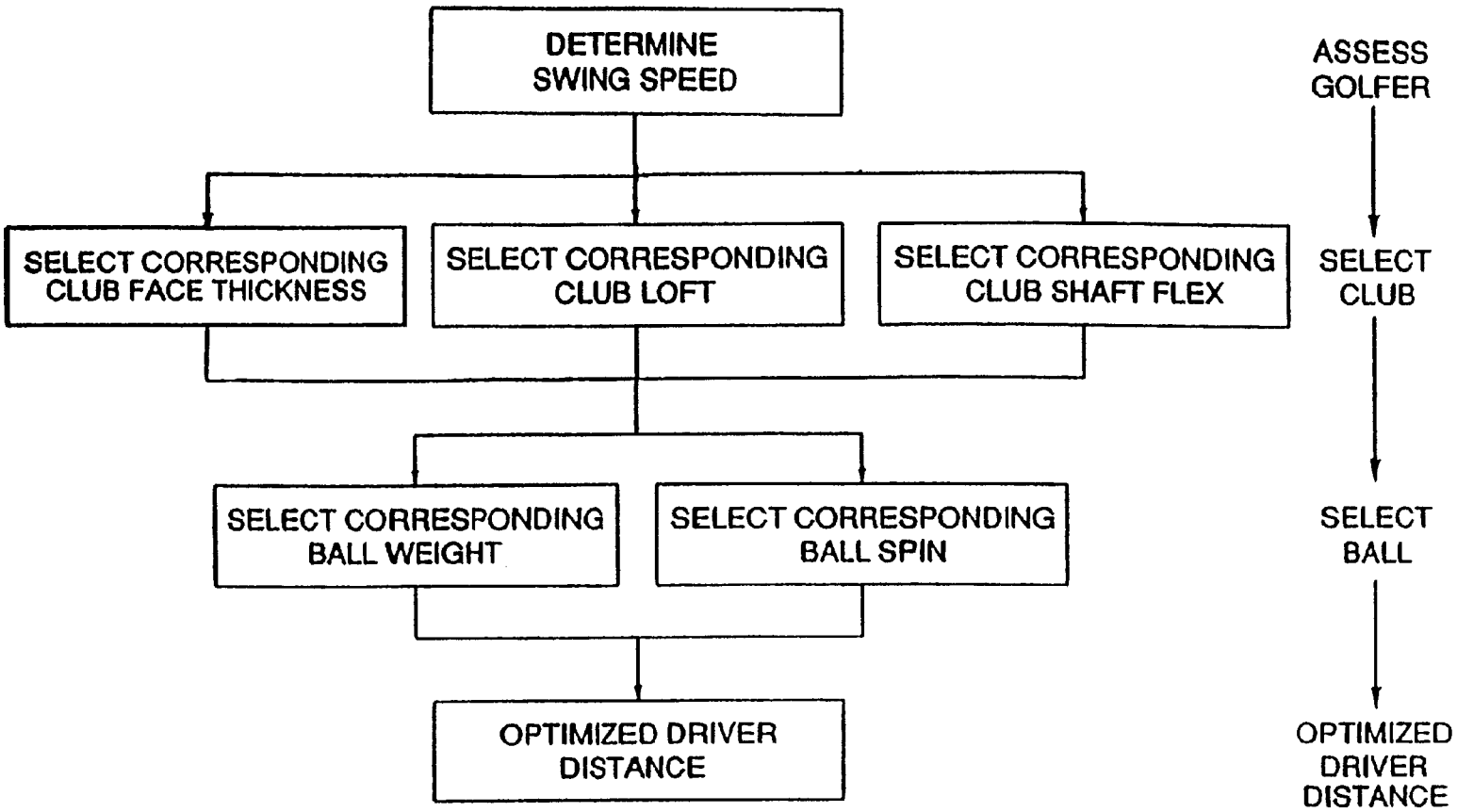
FIG. 1 is a flow chart of the steps involved with fitting a player with a golf club and ball according to the method of the present invention.

The present invention is directed to a streamlined method of fitting a player to a golf club and a golf ball depending on player's swing speed. The present invention employs key variables to match a player to a particular club and a particular ball in a manner that maximizes driving distance. Key variables include, but are not limited to, the swing characteristics of the golfer, the inertial properties of the golf club, shaft characteristics and average club face thickness, and the physical properties of the ball. One embodiment of the present invention, for example, allows the selection of a golf club and a golf ball from a plurality of golf clubs and golf balls by measuring at least one swing characteristic of a golfer and matching that characteristic to key club characteristics and ball characteristics based upon a predetermined relationship between the characteristics.

Swing characteristics may be identified by a number of variables, such as club head speed and angle of attack, the direction of the golfer's swing (e.g., inside-out or outside-in), and the acceleration of the club head prior to impact. Most preferably, the golfer's swing characteristics are defined simply by the golfer's club head speed at impact. There are numerous commercially available products that measure the club head speed of a golfer, which range from simple devices that are clipped onto the club shaft and measure club head speed using light gates to complex stand-alone devices that utilize radar. Although the simpler devices do not have a high degree of accuracy, they are accurate enough to classify a golfer within preferred ranges (i.e., high, medium, and low) set forth in the present invention.

The inertial properties and shaft characteristics of a golf club can be characterized by club head weight, loft angle, roll, bulge, and center of gravity position, as well as the overall flex, flex point, vibrational frequency, and torsional rigidity of the club shaft. In one embodiment, the club characteristics used to select a particular club for a particular player include the golf club loft and overall shaft flex.

The physical properties of a golf ball can be characterized by type, i.e., solid or wound construction, size, weight, initial velocity or coefficient of restitution (COR), spin, compression, hardness, and moment of inertia. In one embodiment, the ball characteristics are weight and spin in matching a ball to a particular player. In addition, certain aerodynamic characteristics, such as lift and drag, may be used to match a particular golfer with a particular golf ball. Because aerodynamic characteristics of a ball may be controlled by certain dimple arrangements and profiles, the dimple count, pattern, profile, and shape may also be used to match a ball to a particular player.

Thus, the present invention is also directed to matching a golfer with particular golf balls having improved aerodynamic efficiency, resulting in uniformly increased flight distance for golfers of all swing speeds. In particular, the selection of certain dimple arrangements and dimple profiles allow manufacturers to obtain a unique set of aerodynamic criteria for a golf ball, which results in consistently improved aerodynamic efficiency. The desired aerodynamic criteria are defined by the magnitude and direction of the aerodynamic force, for the range of Spin Ratios and Reynolds Numbers that encompass the flight regime for typical golf ball trajectories.

Thus, the present invention uses several of the above variables to create a streamlined, but significantly accurate, method to match a golfer with the optimal club and ball. In one embodiment, for example, the club and ball characteristics are a direct linear relationship to the players swing speed for simple fitting. The use of color coded clubs and balls can be used to simply implement the fitting according to the present invention.

For the purposes of this invention, the definitions outlined below in Tables 1–3 are understood to apply to the player, club, and ball characteristics:

TABLE 1

| PLAYER CHARACTERISTICS | |
|---|---|
| | Club head Speed (miles per hour (mph)) |
| High | Greater than about 80 mph |
| Medium | about 60 mph to about 80 mph |
| Low | Less than about 60 mph |

TABLE 2

| CLUB CHARACTERISTICS | |
|---|---|
| Club Loft: | angle between the vertical plane and the face of the club when the shaft is in the vertical plane |
| | Shaft Flex[1] |
| A | Senior Flex |
| R | Regular Flex |
| S | Stiff Flex |
| XS | Extra Stiff Flex |

[1]Flex as determined by weight and shaft deflection.

TABLE 3

| BALL CHARACTERISTICS | |
|---|---|
| | Ball Weight (ounces (oz.)) |
| normal | 1.58 oz. to 1.62 oz. |
| light | 1.54 oz. to 1.62 oz. |
| | Ball Spin[2] (revolutions per minute (rpm)) |
| high | > about 3500 rpm |
| medium | about 3200 rpm to about 3500 rpm |
| low | < about 3200 rpm |
| | Ball Speed (miles per hour (mph)) |
| high | ≧ about 145 mph |
| medium | about 144 mph to about 125 mph |
| low | ≦ about 124 mph |

[2]When hit by a True Temper machine under USGA standards.

In one embodiment of the invention, six variables are selected for use in the fitting method, which include club head speed, club loft angle, club shaft flex, average club face thickness, golf ball weight, and golf ball spin. In this embodiment, only one variable is specific to the player, only three variables are specific to the golf club, and only two variables are specific to the golf ball, which greatly simplifies matching the ball and club with the golfer.

To maximize driver distance, for example, the ball's launch conditions should be optimized so that the ball has a high initial velocity for the player's club head speed, a relatively high launch angle, and a relatively low spin. In this embodiment, the launch angle preferably is preferably greater than about 10 degrees and more preferably greater than about 12 degrees. It is also preferred that the ball spin be less than about 3000 rpm. To achieve these optimum conditions, the golfer's swing characteristics, the golf club's shaft and head physical properties, and the golf ball's physical properties and aerodynamic properties should work together to provide the optimum driver distance.

In another embodiment, dimple arrangement, shape, and coverage, as well as the resulting lift and drag coefficents of the golf ball may be used to match a particular golf ball with a golfer depending on the swing speed of the golfer.

Method of Invention

Achieving optimum distance involves three basic steps: (1) assessing the golfer's swing characteristics; (2) selecting the proper club characteristics to suit the golfer's swing; and (3) selecting the proper ball to match the golfer and club combination. Determining the golfer's swing characteristics allows proper club selection so that club head speed at the time of impact with the ball can be maximized. As further explained below, maximizing club head speed is determined by the golfer's swing characteristics, the shaft flex and the inertial properties of the golf club head.

FIG. 1 generally shows the method of the present invention. First, a measurement of the golfer's swing characteristic is made. In one embodiment, the golfer's club head speed is obtained during this step and, based on the players club head speed, the golfer is fitted to the golf club having the proper club characteristics based upon a predetermined relationship between the selected club characteristics and the swing characteristic.

The golfer's club head speed may be determined using any available device. Preferably, a device such as the Mini-Pro 100 Golf Swing Analyzer, the Pro V Golf Swing Analyzer or the Pro III Golf Swing Analyzer available from GolfTek of Lewiston, ID 83501; the DeadSolid Golf Simulator from DeadSolid Golf of Pittston, Pa. 18640; or the Double Eagle 2000 from Par T Golf of Las Vegas, Nev. 89128 is used to measure the club head speed at impact during a golfer's swing. In one embodiment, the golfer's swing speed is measured using a golf club having a length between 43½ to 46 inches. In another embodiment, the golfer's club head speed is measured using a club of 44 inches long. The swing speed can then be classified as high, medium or low as set forth by the definitions above.

In addition, the ball speed may be similarly used. For example, a measurement of the ball speed is made as the ball comes off of the club face. The golfer may be fitted to an optimum golf ball, golf club, or combination thereof based on a predetermined relationship between the player's high, medium, or low ball speed and a particular ball or club characteristic.

Club Selection

Figure 2:
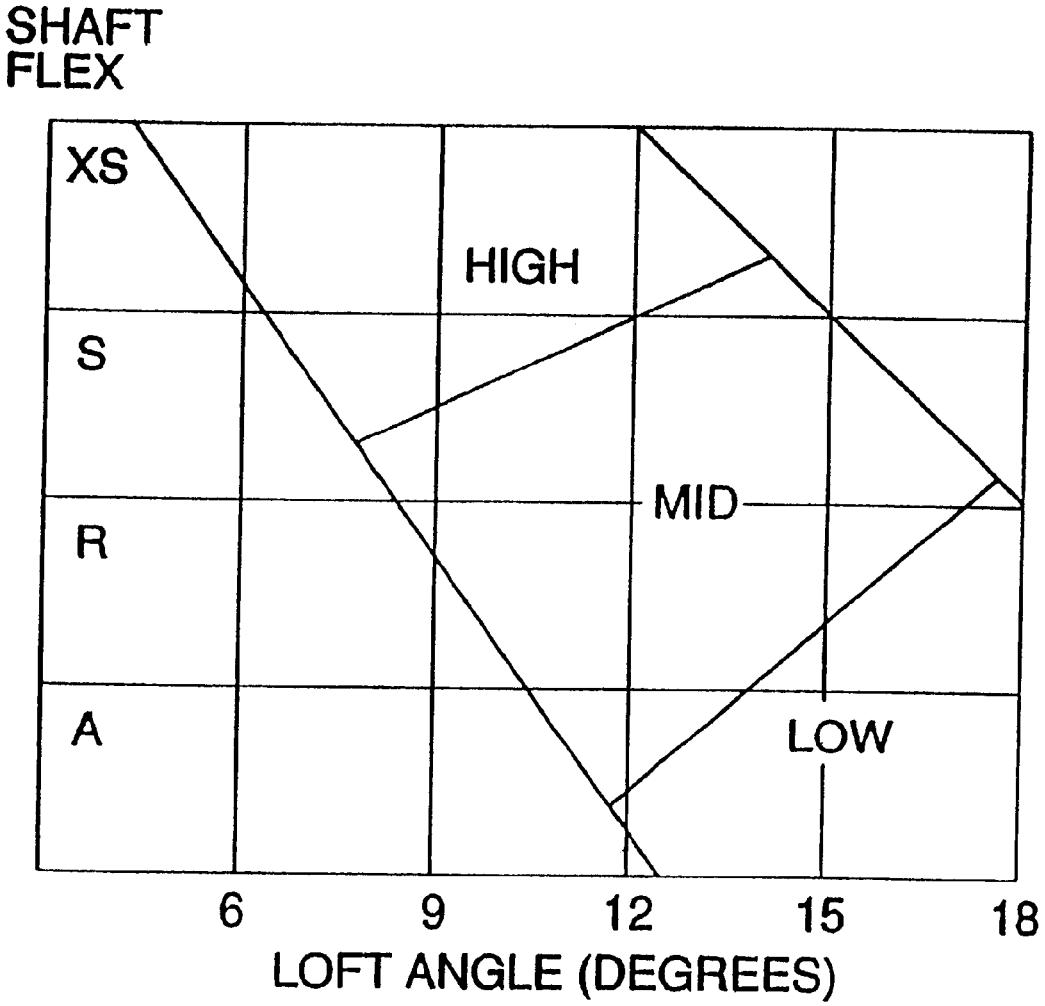
FIG. 2 is a chart correlating loft angle and shaft flex with golfer swing speed.
Figure 3:
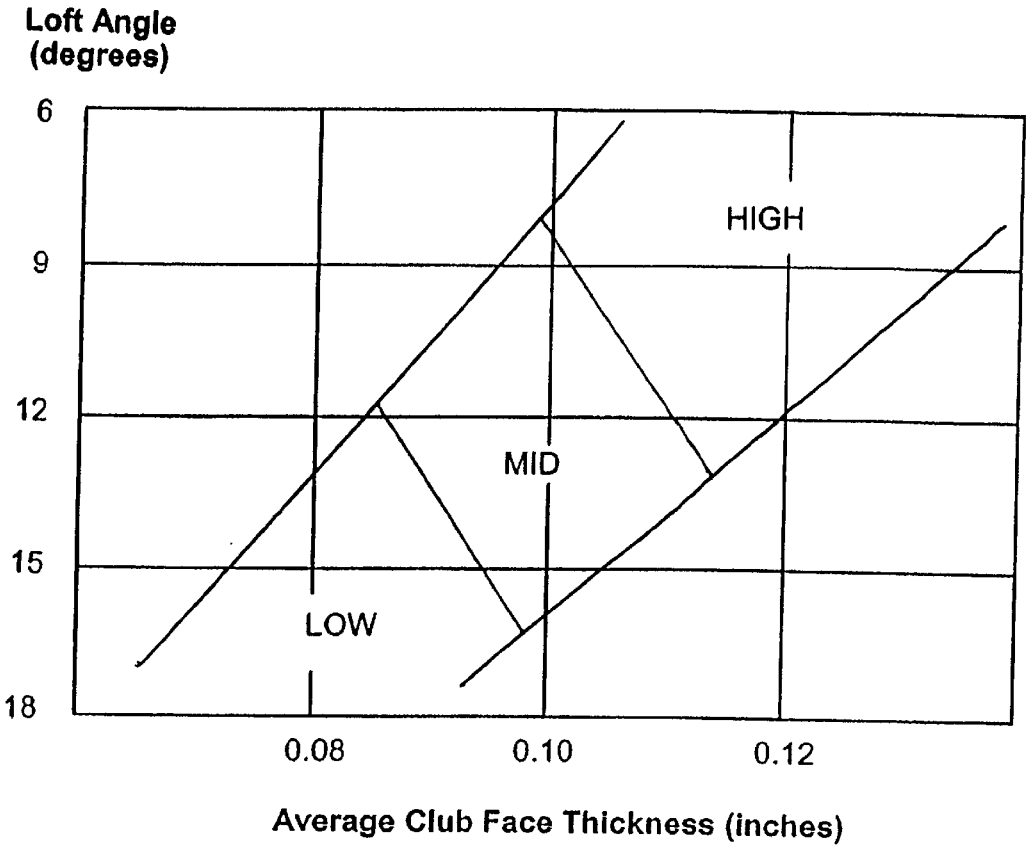
FIG. 3 is a chart correlating average club face thickness and loft angle with golfer swing speed.

Once a golfer's club head speed has been assessed, a club may be selected using a direct linear relationship, as illustrated in FIGS. 2 and 3, between club characteristics such as loft angle, shaft flex, and club face thickness and the player's club head speed. As shown in FIG. 2, the lofts and shaft flexes can be selected by first classifying the golfer into a high, medium or low swing speed using the definitions above or by using a direct relation to the swing speed, preferably within the boundaries set forth therein.

Determining the club head of loft woods and irons is well known in the art and is further codified in Ralph Maltby's *Golf Club Design, Fitting, Alteration and Repair*, $2^{nd}$ edition, pg. 310–324. The loft of a club is preferably selected based on the natural loft, i.e., the loft of the wood measured by the angle between the face of the wood, measured at ½ the face height, and the sole of the wood less ninety degrees. It is important to note that the loft of a wood club is measured differently than an iron and, thus, if the present invention is being used to fit an iron, the loft is calculated by measuring the angle between the shaft bore or hosel to the club face.

When matching a particular driver to a particular golfer, clubs may be chosen from a preselected set of the same driver having differing loft angles, e.g., the Titleist Titanium 975D drivers, which come in lofts of 5.5, 6.5, 7.5, 8.5, 9.5, 10.5 and 11.5 degrees. The lofts that are selected will depend on different parameters such as the club head size and location of the center of gravity. Generally, the larger the club head the less loft is required for a specific hitter because of the increase in dynamic loft. Therefore, the loft angles shown in FIG. 2 are representative of the actual set of lofts that may be selected by someone of ordinary skill in the art, but are not intended to limit the invention to just the lofts shown therein.

Thus, once the golfer's swing speed is measured and classified as high, medium and low, the appropriate golf club loft for that particular swing speed may be selected from a plurality of lofts based on a direct linear relationship between the golfer's swing speed and the club head loft. Likewise, the golf club shaft may be selected using a predetermined relationship, such as the direct linear relationship illustrated in FIG. 2, between the shaft flex and the golfer's swing speed.

Determining the shaft flex is well know in the art and clearly set forth in Ralph Maltby's *Golf Club Design, Fitting, Alteration and Repair*, $2^{nd}$ edition, pg. 481–494. Generally though, because drivers come in different flexes set by the shaft manufacturer, the present invention is directed to fitting a golfer to a particular driver having a specific shaft flex. Table 4 identifies different shaft flex properties that can be followed.

TABLE 4

| Shaft Flex | | | | |
|---|---|---|---|---|
| Material | Length (inches) | Label | Frequency (CPM) | Weight (gms) |
| Steel | 43 | Senior | 235 | |
| Steel | 43 | Regular | 250 | 120.5 |
| Steel | 43 | Stiff | 260 | 121.0 |
| Steel | 43 | X-Stiff | 273 | 124.0 |
| Graphite | 43 | Regular | 270 | 92.0 |
| Graphite | 43 | Stiff | 276 | 93.0 |
| Graphite | 43 | X-Stiff | 290 | 93.0 |

The shaft flex is preferably selected from A, R, S, and XS (as defined above). In one embodiment, the shaft flex is selected based on the deflection and weight of the shaft.

Average club face thickness is another parameter that can be used to fit the proper club with a particular golfer. Club face, as used herein, is understood to mean the substantially planar surface of the club used to hit the golf ball. For the purposes of the invention, the club face can be of uniform thickness or may vary in thickness from location to location. In either case, determining the average club face thickness is accomplished by measuring the club face thickness at various locations and arriving at an average value.

In determining what club to select for a particular player, the average club face thickness can be selected according to the player's club head speed. More particularly, the desired average club face thickness for a particular player may be selected from a chart correlating player club head speed with suitable average club face thickness, as illustrated in FIG. 3. For example, a player with a relatively low club head speed may be matched with a club having an average club face thickness of between about 0.07 to about 0.09 inches. Likewise, a player with an average, or mid-range, club head speed may be matched with a club having an average club face thickness between about 0.09 to about 0.11 inches, and a player with a high swing speed may be matched with a club having an average club face thickness of between about 0.10 to about 0.13 inches. The average club face thicknesses shown in FIG. 3 and described herein are intended to illustrate the club face thickness selection, but are not intended to limit the invention to those thicknesses shown and described herein. The invention covers, for example, all club face thicknesses that are sufficient to provide durability.

The ranges set forth by the two linear boundaries in FIGS. 2 and 3 of the fitting parameters are linear fits of golf club characteristics to golfer characteristics and there are many different direct relations that can be chosen based on the manufacturer's criteria. As discussed above, different manufacturers will have different sized club heads, different locations for the center of gravity, and the like, which will change the launch condition of a golf ball.

While FIGS. 2 and 3 are shown and described with high, medium, and low club head speed, this concept may be extended to use ball speed in a similar manner. For example, for the purposes of the invention, FIG. 2 may also represent a correlation between high, medium, and low ball speeds and loft angle (x-axis) and shaft flex (y-axis). Once the ball speed is determined, the optimum loft angle and/or shaft flex may be selected for a player based on that correlation. In addition, FIG. 3 may represent a correlation between high, medium, and low ball speeds and average club face thickness (x-axis) and loft angle (y-axis). Once the ball speed and club face thickness are obtained, the optimum club face thickness and/or loft angle may be selected for a player based on that correlation.

In addition to the club characteristics discussed above, coefficient of restitution (COR) of the club is useful in matching a particular golfer with a specific club because COR affects ball flight and total travel distance. It is preferred that as much energy as possible is transferred from the moving club head to the stationary golf ball, and that the golf ball leaves the face of the club with maximum ball speed at an appropriate launch angle and spin. This transfer of energy is influenced by the coefficient of restitution (COR) between the club and the ball during impact and is a function of the ball mass, club mass, club face thickness, elastic modulus of the club, and resiliency of the ball. The physical properties of the materials used to form both the club and the ball, as well as the thickness and other dimensions of the chosen materials, determine the COR resulting from the club-ball impact.

The USGA has established rules and measurement procedures regarding club COR. For example, Rule 5 in Appendix II prohibits the club face from having the effect at impact of a spring with a golf ball and, in 1998, the USGA adopted a test procedure pursuant to Rule 5 which measures club face COR. This USGA test procedure, as well as similar procedures, may be used to measure club face COR. In simple terms, club COR is the measurement of the rebound a golf ball has off of the clubface (an 0.83 COR corresponds to a golf ball that impacts the face of a driver at 100 mph and comes off of the club face at 83 percent of the speed or 83 mph). In 2002, the USGA and The Royal & Ancient Golf Club of St. Andrews, Scotland (R&A) set forth a uniform, worldwide standard of 0.83 COR for clubs. The USGA ruled that the 0.830 COR limit applied to all golfers in the United States who wished to post a score for handicap purposes, while the R&A, which previously had no limits on COR for either professionals or amateurs, recommends its adoption for professionals beginning 2003. Amateur golfers in areas ruled by the R&A will have no limitations on COR until 2008.

Club COR is discussed in commonly assigned U.S. patent application Ser. No. 09/551,771 entitled "Golf Club Head with a High Coefficient of Restitution," which is incorporated herein by reference in its entirety. Applying the teachings, club COR is preferably about 0.800 or greater, more preferably about 0.820 or greater, and even more preferably about 0.825 or greater. Because of the differences between the USGA and R&A regarding club COR, it may be possible to obtain a different result depending on which rules are used. For example, in one embodiment of the present invention, it is preferred that the club have a COR less than the maximum permitted by the USGA Rules, i.e., less than about 0.830. In another embodiment the club COR is about 0.83 or greater.

As mentioned, COR can be used to determine what club should be used. For example, suppose a player can choose from a variety of clubs having a COR of 0.80 but having differing loft angles. If the player has a low swing speed, then the player should choose a club having a loft angle of at least about 10.50. If the player has a medium swing speed, then the player should choose a club having a loft angle of from about 9° to about 11°. If the player has a high swing speed, the player should choose a club having a loft angle from about 6° to about 10°. These results are presented below in Table 5.

TABLE 5

Relationship Between Swing, Club COR, and Loft Angle

| Swing Speed | Club COR | Loft Angle (degrees) |
|---|---|---|
| Low | .80 | 10.5+ |
| Medium | .80 | 9–11 |
| High | .80 | 6–10 |

Figure 4:
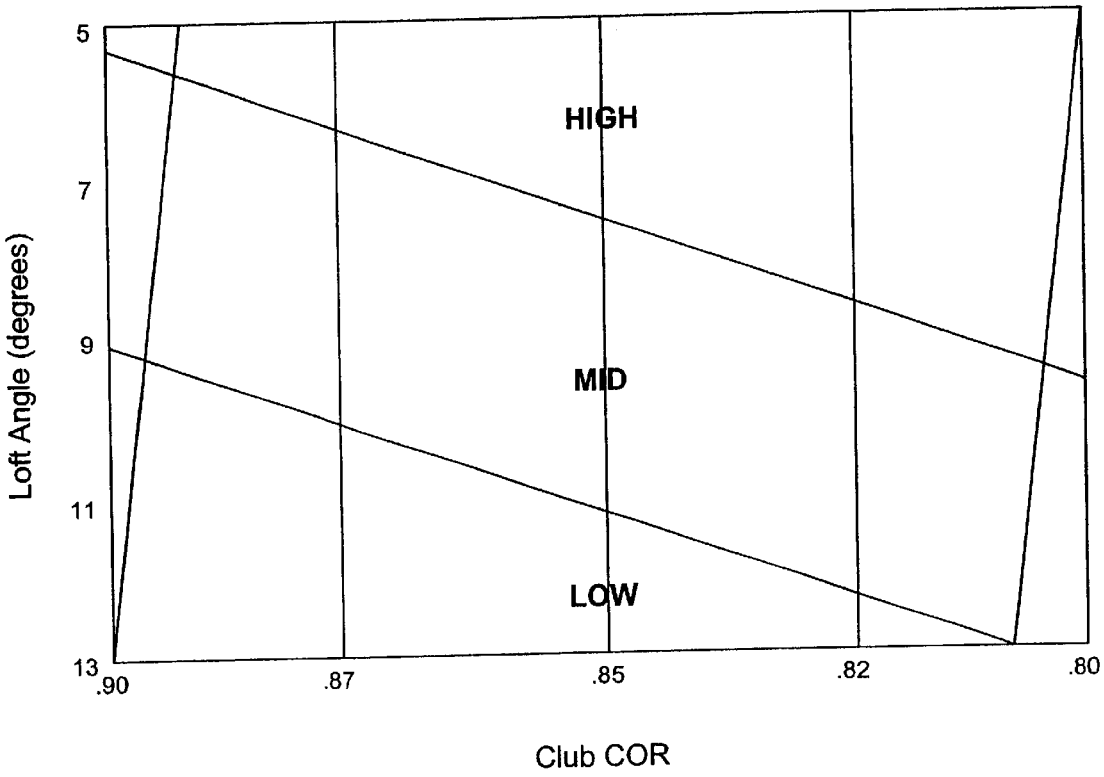
FIG. 4 is a chart correlating ball weight and ball spin with golfer swing speed.

FIG. 4 illustrates how COR can be used in combination with the player's swing speed to determine the proper club. As shown, COR and swing speed can be used to determine the proper loft angle the player should use by (1) determining the desired COR value, (2) matching the value with the player's swing speed, and (3) using the vertical axis to find the proper range of loft angles the player should use.

As discussed above, while FIG. 4 is shown and described with respect to high, medium, and low club head speed, this concept may be extended to use ball speed in a similar manner. For example, FIG. 4 may also represent a correlation between high, medium, and low ball speeds and club COR (x-axis) and loft angle (y-axis). Once the ball speed is determined, the optimum club COR and/or loft angle may be selected for a player based on that correlation.

Ball Selection Based on Weight and Spin

After the proper club has been selected, the next step is to select a golf ball based upon a predetermined relationship between the selected golf ball characteristics and the swing characteristic. The characteristics preferably used in a ball selection are ball weight, ball spin, ball compression, number of dimples, dimple diameter, and ball lift and drag coefficients.

Figure 5:
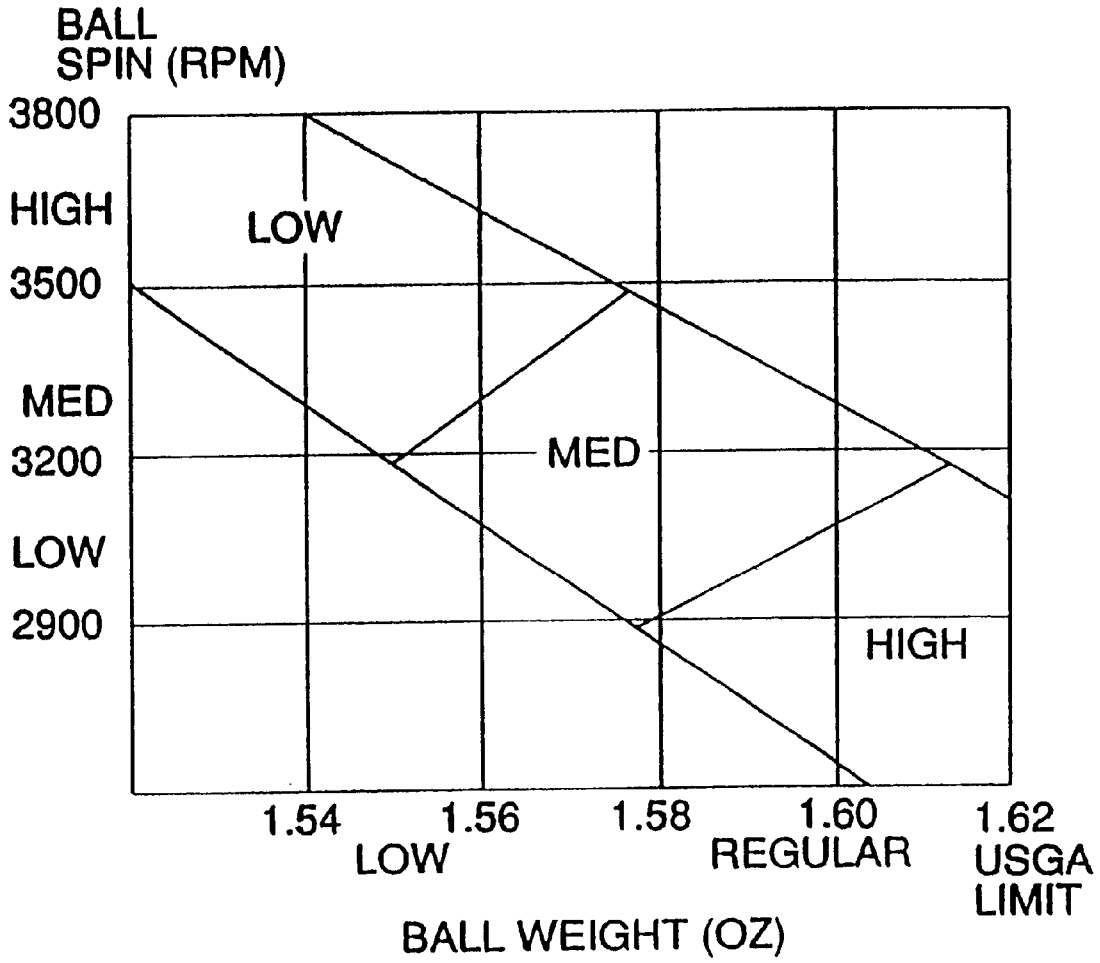
FIG. 5 is a chart correlating club coefficient of restitution and loft angle with golfer swing speed.

As shown in FIG. 5, for example, a ball may be selected from a plurality of balls based on a direct linear relationship between the swing characteristic and ball weight and ball spin. The ball can be one of a plurality having a numerical weight and/or spin or can be classified as regular or low weight and high, medium, or low spin as set forth by the definitions above and as shown in FIG. 5.

The golf ball weight is selected using a predetermined relationship, such as the direct linear relationship shown in FIG. 5, between the golf ball weight and the golfer's swing speed. In one embodiment, the golf ball is selected from low weight balls or regular weight balls as defined above. However, the ball weight can also have a linear relationship with the swing speed directly by providing a plurality of predetermined numerical weights for golf balls as illustrated in FIG. 5. Generally though, the present invention is directed to fitting a golfer to a ball which generally come in different weights as set forth by the ball manufacturer.

After the ball weight is matched with a golfer's swing speed, the golf ball spin is selected using a predetermined relationship between the golf ball spin and the golfer's swing speed (FIG. 5). The golf ball may be selected from low spin balls, medium spin balls, or high spin balls as defined above and as shown in FIG. 5. However, the ball spin may have a linear relationship with the swing speed directly by providing a plurality of predetermined spin rate balls and matching them to particular swing speeds as shown by the upper and lower boundaries set forth in FIG. 5. Generally though, the present invention is directed to fitting a golfer to a ball, wherein the balls typically have different spin rates as set forth by the ball manufacturer and the spin rates are matched to particular swing speed players.

In addition, FIG. 5 may be representative of a correlation between high, medium, and low ball speeds and ball weight (x-axis) and ball spin (y-axis). Once the ball speed is determined, the optimum ball weight and/or ball spin may be selected for a player based on that correlation.

Figure 6:
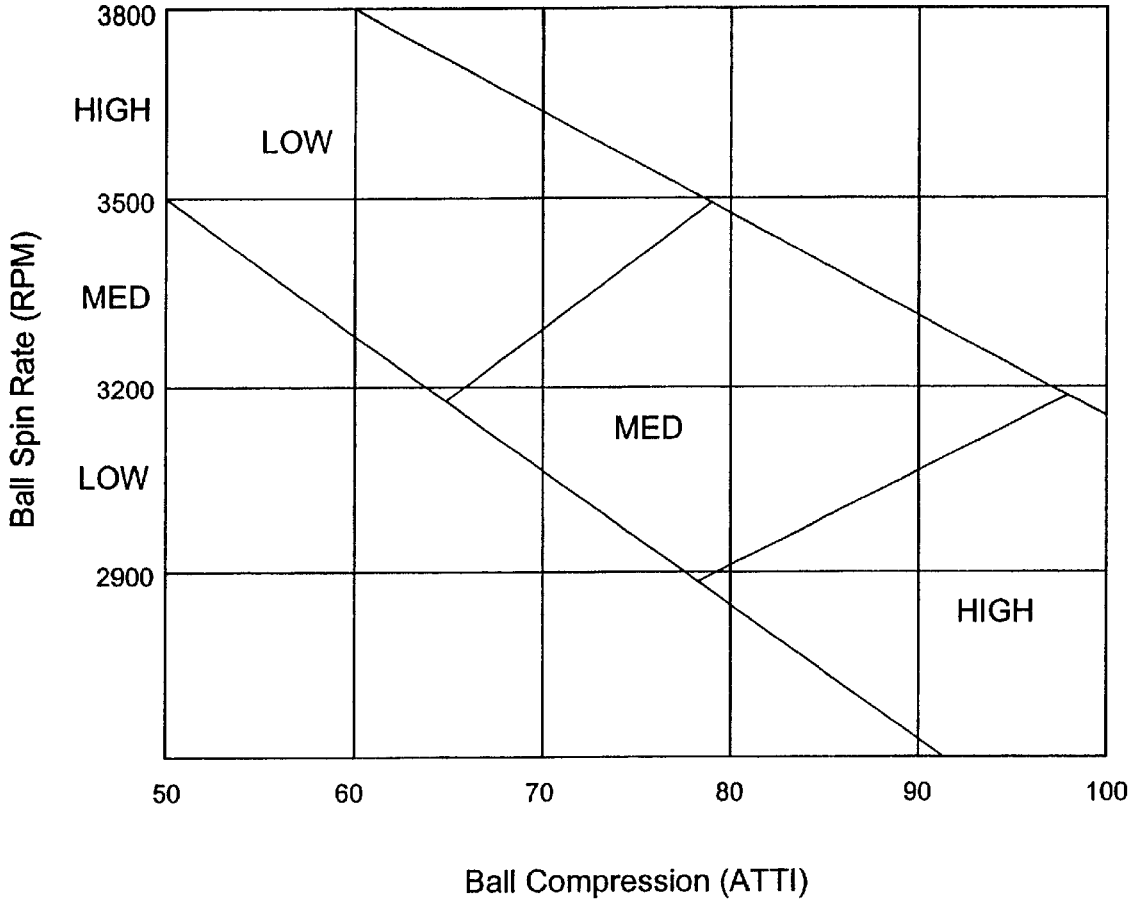
FIG. 6 is a chart correlating ball compression and ball spin rate with golfer swing speed.

FIG. 6 shows that golf ball spin may be selected using a predetermined relationship between the golf ball compression and the golfer's swing speed. Compression is a measure of a golf ball's resistance pressure to compressive stresses, i.e., the degree to which the shape of a golf ball changes when subjected to a compressive load. In the golf ball industry, compression is rated on a scale of 0 (softest) to 200 (hardest), where each point represents 1/1000th of an inch of deflection in a ball under load applied by a standard weight. A rating of 200 indicates that the ball does not compress, whereas a rating of 0 indicates a deflection of 2/10ths of an inch or more. The construction of a golf ball and the materials used for its cover, inner layers, and core contribute to a ball's overall compression rating. Golf ball compression is typically measured using an Atti Compression Gauge, which is commercially available from Atti Engineering Corp. of Union City, N.J., and is typically referred to as "Atti compression."

Higher compression-rated golf balls are harder and can come off the club "hotter," with increased distance both off the tee and from the fairway. Because harder golf balls do not make as much contact with the club face as softer balls, they have less "feel" at lower rates, and can restrict "shape" shots for lower swing speeds. Lower compression-rated golf balls offer greater feel and control for lower swing speeds. Because it is softer, the ball remains in contact with the club face longer. These balls maximize a slow swing speed player's ability to compress the ball.

The golf balls of the invention are preferably selected from low compression balls, medium compression balls, and high compression balls as defined above and as shown in FIG. 6. However, the ball compression can also have a linear relationship with the swing speed directly by providing a plurality of predetermined compression balls and matching them to particular swing speeds as shown by the upper and lower boundaries set forth in FIG. 6. The present invention is generally directed though to fitting a golfer to a ball that generally comes with different compressions as set forth by the ball manufacturer and then the compression is matched to particular swing speed players.

While FIG. 6 is shown and described with respect to high, medium, and low club head speed, this concept may be similarly extended to high, medium, and low ball speed. For example, FIG. 6 may also represent a correlation between high, medium, and low ball speeds and ball compression (x-axis) and ball spin rate (y-axis). Once the ball speed is determined, the optimum ball compression and/or ball spin rate may be selected for a player based on that correlation.

Ball Selection Based on Dimples

Figure 7:
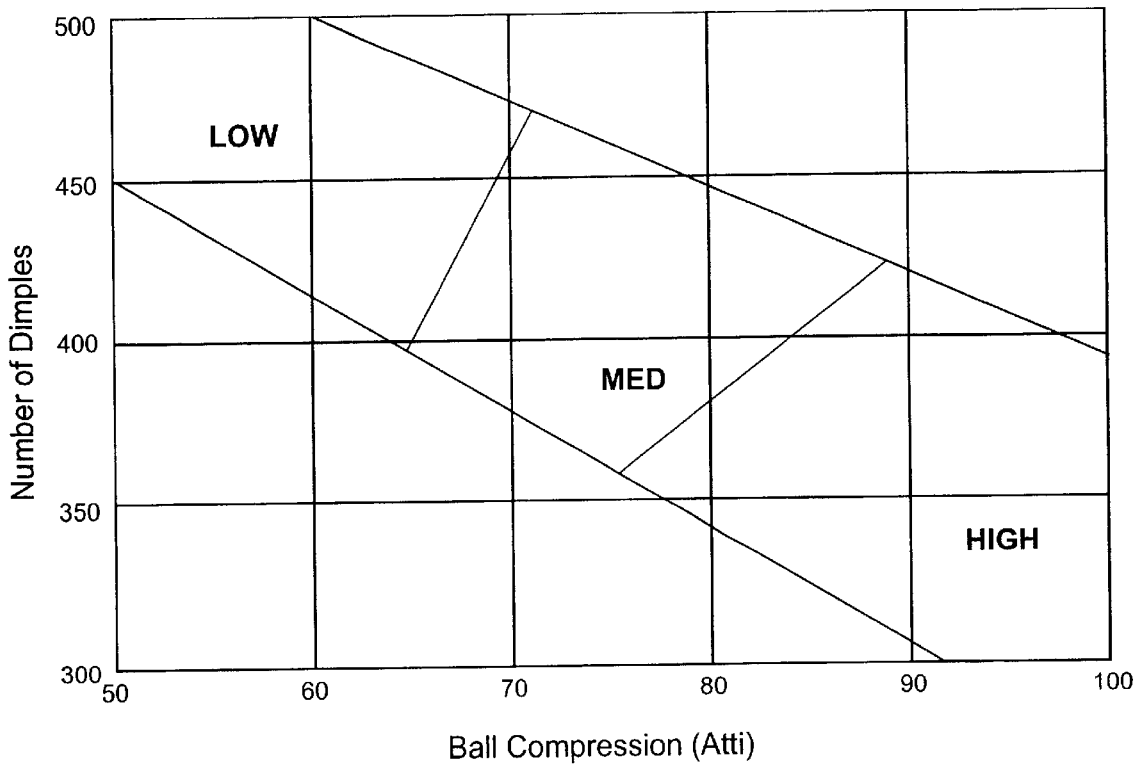
FIG. 7 is a chart correlating ball compression and number of dimples on a golf ball with golfer swing speed.

After ball compression is matched with a golfer's swing speed, the number of dimples on a golf ball may be selected using a predetermined relationship between the number of dimples and the golfer's swing speed (FIG. 7). The golf ball may be selected from a plurality of balls having a predetermined number of dimples matching them to particular swing speeds as shown by the upper and lower boundaries set forth in FIG. 7. Generally though, the present invention is directed to fitting a golfer to a ball, wherein the balls typically have different dimple counts as set forth by the ball manufacturer and the number of dimples are matched to particular swing speed players.

In one embodiment, the golf balls according to the present invention have about 300 to about 500 total dimples as denoted on the y-axis of the chart in FIG. 7. In another embodiment, the dimple patterns are icosahedron patterns with about 350 to about 450 total dimples. For example, the golf ball of FIGS. 8–9 have 362 dimples. In the golf ball shown in FIGS. 10–13, there are 392 dimples and in the golf ball shown in FIGS. 14–15, there are 440 dimples.

Figure 16:
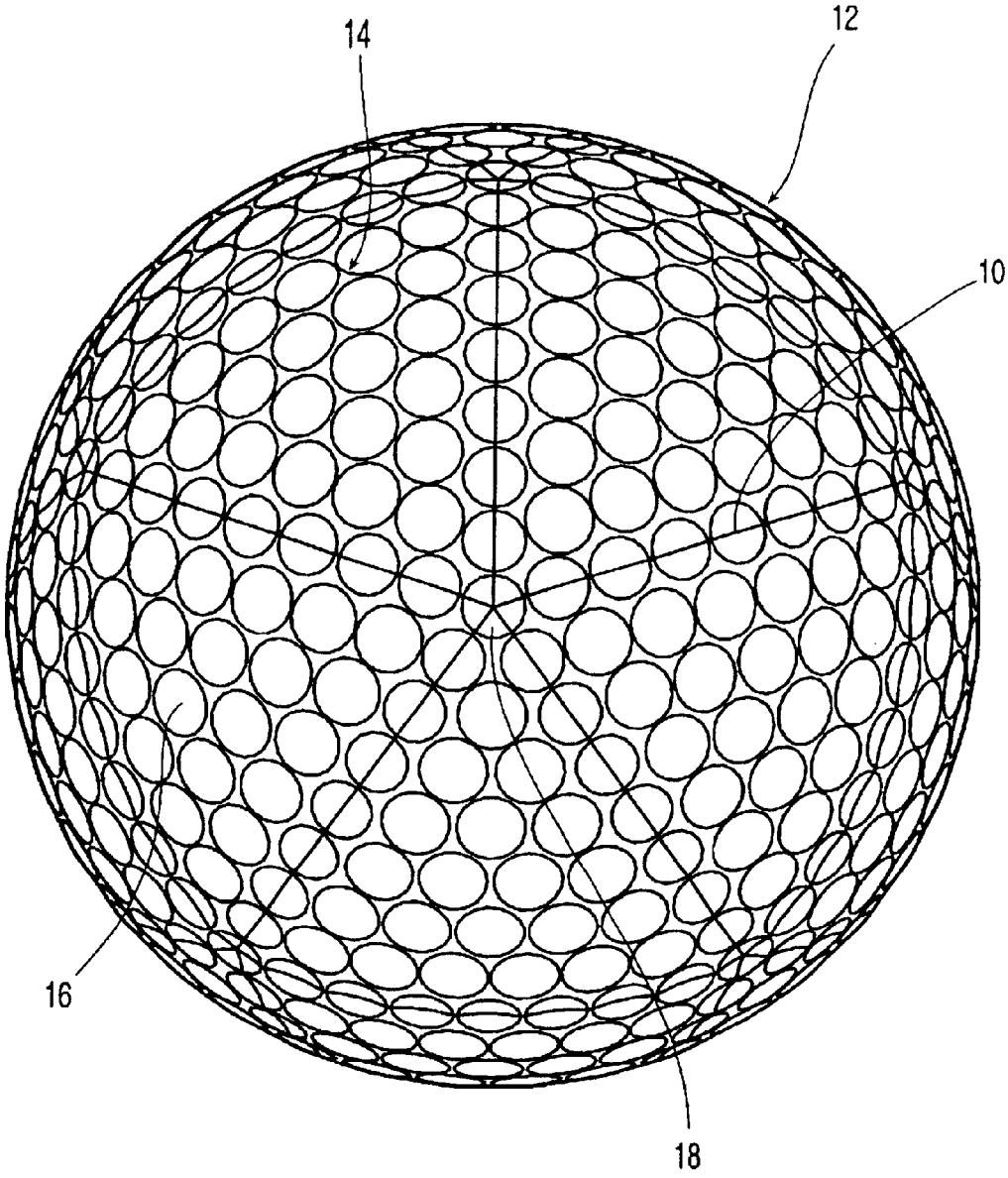
FIG. 16 is a perspective view of a golf ball having over 500 dimples designed primarily for low swing speed players.

As shown in FIG. 7, golfers with lower swing speeds may be fitted to a golf ball having a higher number of dimples, e.g., greater than about 400 dimples. In one embodiment, a low swing speed player is fitted to a golf ball having about 450 dimples or greater. In addition, while the y-axis of FIG. 7 does not continue past 500 dimples, the present invention contemplates golf balls having over 500 dimples. For example, FIG. 16 denotes a golf ball having 642 dimples, which is particularly suited for low swing speed players. Such balls are described in U.S. Pat. No. 6,299,552, which is incorporated in its entirety by reference herein.

FIG. 7 also shows that golfers having medium to high swing speed are better fit with a golf ball having less than about 400 dimples. For example, a golf ball having 392 dimples, as described in U.S. Pat. No. 5,957,786, which is incorporated by reference in its entirety herein, is particularly suited for medium to high swing speed players.

Figure 19:
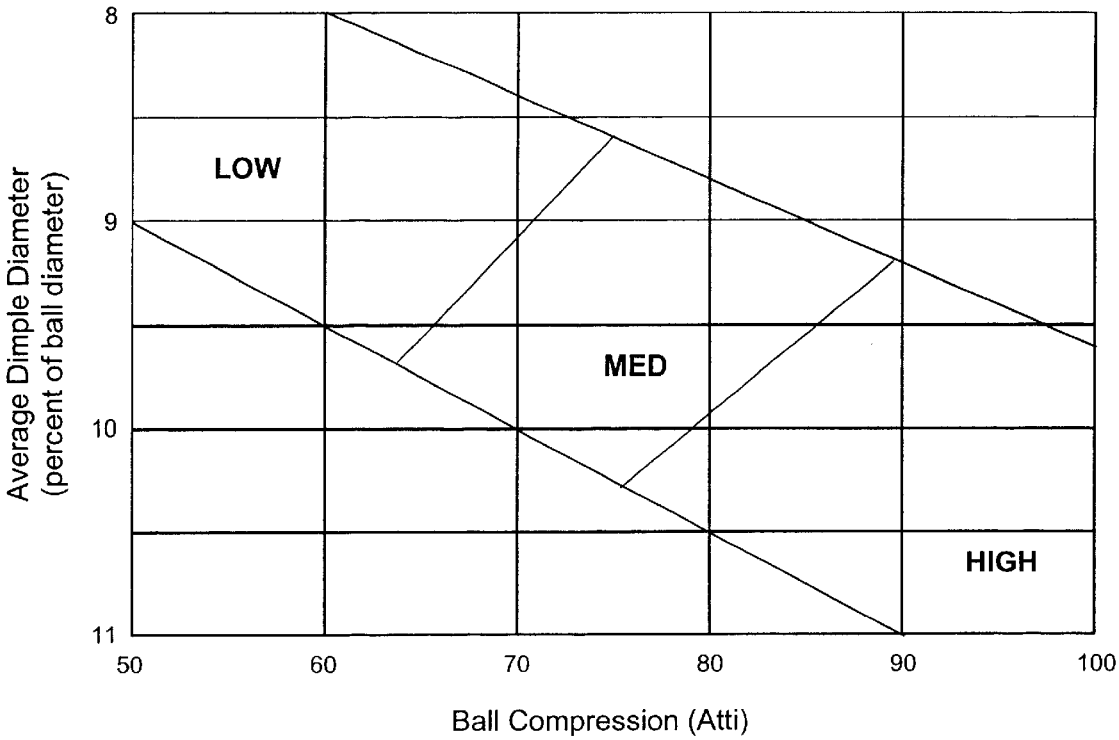
FIG. 19 is a chart correlating ball compression and average dimple diameter with golfer swing speed.

The dimple diameter may also be selected using a direct linear relationship between the average dimple diameter and the golfer's swing speed, as shown in FIG. 19. The golf ball may be selected from a plurality of balls having dimples with a predetermined average dimple diameter, which are then matched to particular swing speeds as shown by the upper and lower boundaries set forth in FIG. 19. The present invention is generally directed though to fitting a golfer to a ball that generally comes with different average dimple diameters as set forth by the ball manufacturer and then the average dimple diameter is matched to a particular swing speed player.

This concept my be similarly applied to interpret FIGS. 7 and 19 as correlations between ball speed and number of dimples or average dimple diameter. For example, FIG. 7 may be representative of a correlation between high, medium, and low ball speeds and ball compression (x-axis) and number of dimples (y-axis). Once the ball speed is determined, the optimum club ball compression and/or number of dimples may be selected for a player based on that correlation. And, for the purposes of the invention, FIG.

19 may also demonstrate the relationship between high, medium, and low ball speeds and ball compression and average dimple diameter. Once the ball speed is determined, FIG. 19 enables proper ball selection based on ball compression and/or average dimple diameter.

As shown in FIG. 19, the average dimple diameter for low swing speed players is relatively low compared to the average dimple diameter for medium to high swing speed players. For example, a low swing speed player may be best fitted with a golf ball having an average dimple diameter of about 9.5 or less, whereas a high swing speed player may be better fitted with a golf ball having an average dimple diameter of about 9.5 or greater.

In one embodiment, at least about 80 percent of the dimples have a diameter of about 6.5 percent of the ball diameter or greater so that the majority of the dimples are sufficiently large to assist in creating the turbulent boundary layer. In another embodiment, at least about 90 percent of the dimples have a diameter of about 6.5 percent of the ball diameter or greater. In yet another embodiment, at least about 95 percent of the dimples have a diameter of about 6.5 percent of the ball diameter or greater. For example, all of the dimples have a diameter of about 6.5 percent of the ball diameter or greater in the ball illustrated by FIGS. 10–13.

While several embodiments are discussed above for dimple count and dimple diameter, the type of dimple pattern and profile selected from the ball ultimately controls the number of dimples on the ball or the diameter of the dimples contained thereon. As used herein, the term "dimple", may include any texturizing on the surface of a golf ball, e.g., depressions and extrusions. Some non-limiting examples of depressions and extrusions include, but are not limited to, spherical depressions, meshes, raised ridges, and brambles. The depressions and extrusions may take a variety of planform shapes, such as circular, polygonal, oval, or irregular. Dimples that have multi-level configurations, i.e., dimple within a dimple, are also contemplated by the invention to obtain desirable aerodynamic characteristics.

Dimple patterns that provide a high percentage of surface coverage are preferred, and are well known in the art. For example, U.S. Pat. Nos. 5,562,552, 5,575,477, 5,957,787, 5,249,804, and 4,925,193 disclose geometric patterns for positioning dimples on a golf ball. In one embodiment of the present invention, the dimple pattern is at least partially defined by phyllotaxis-based patterns, such as those described U.S. Pat. No. 6,338,684, which is incorporated by reference in its entirety. In one embodiment, a dimple pattern that provides greater than about 50 percent surface coverage is selected. In another embodiment, the dimple pattern provides greater than about 70 percent surface coverage, and more preferably, the dimple surface coverage is greater than 80 percent.

Figure 13:
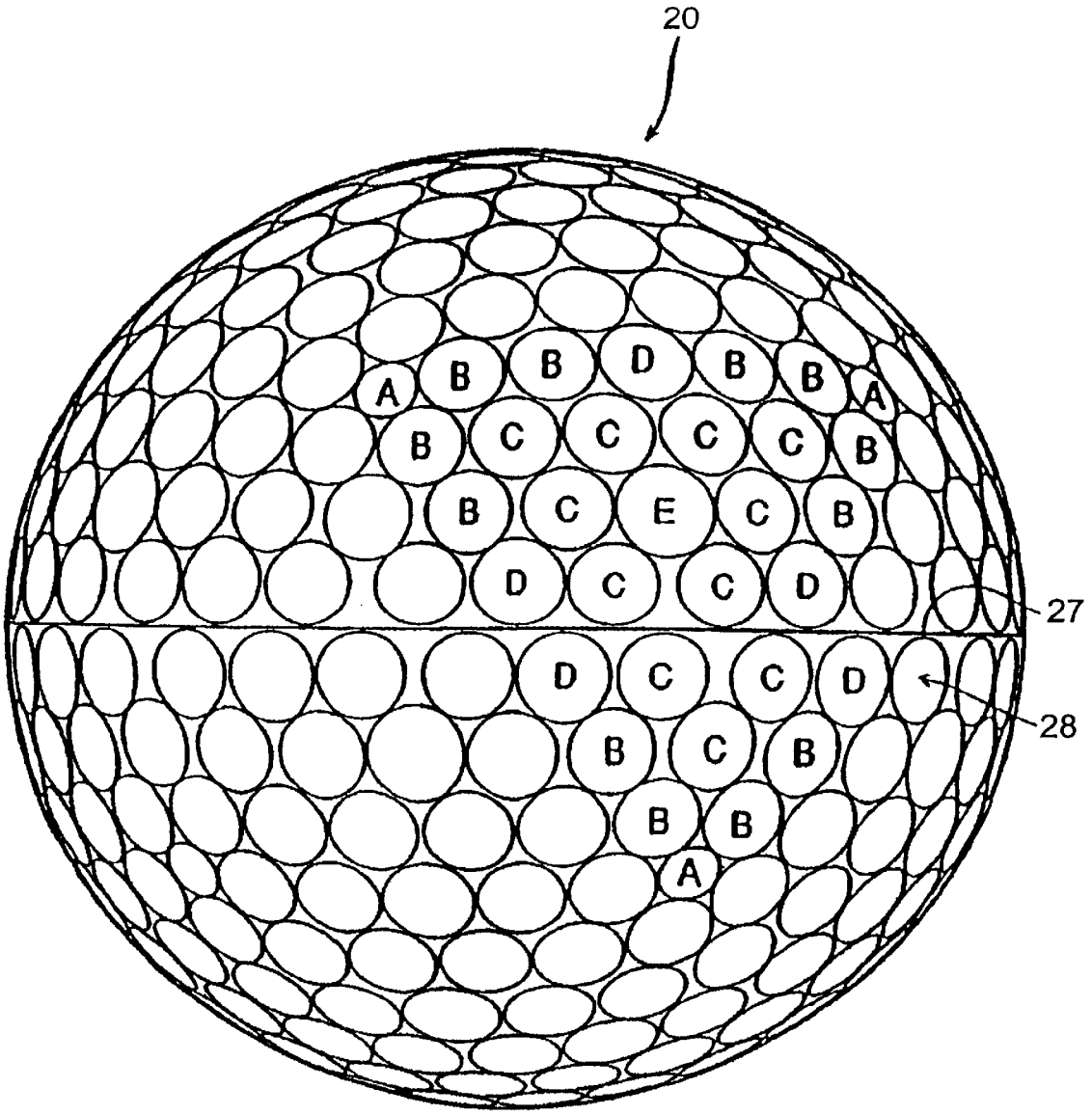
FIG. 13 is a side view of the golf ball in FIG. 10, showing the dimple arrangement at the equator.
Figure 14:
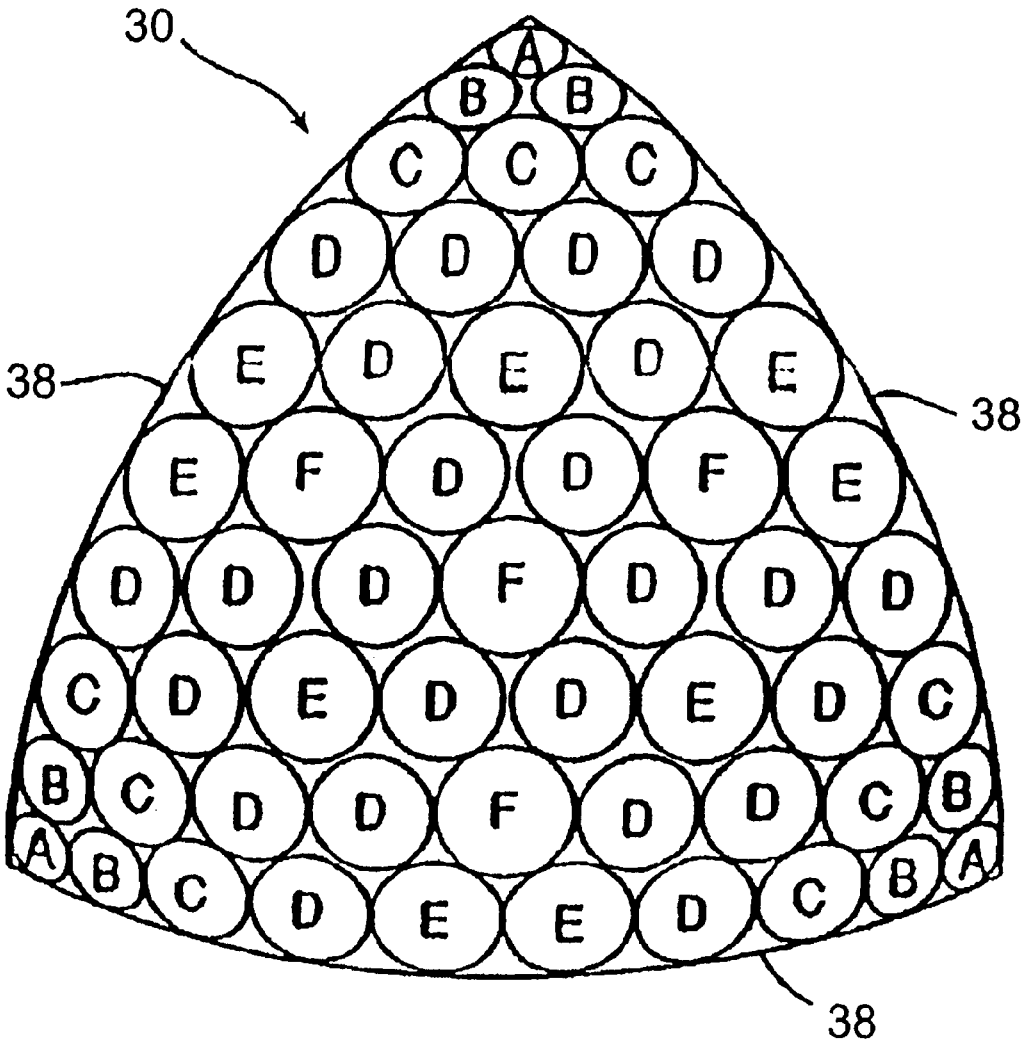
FIG. 14 is a spherical-triangular region of a golf ball according to the present invention having an octahedral dimple pattern, showing dimple sizes.
Figure 15:
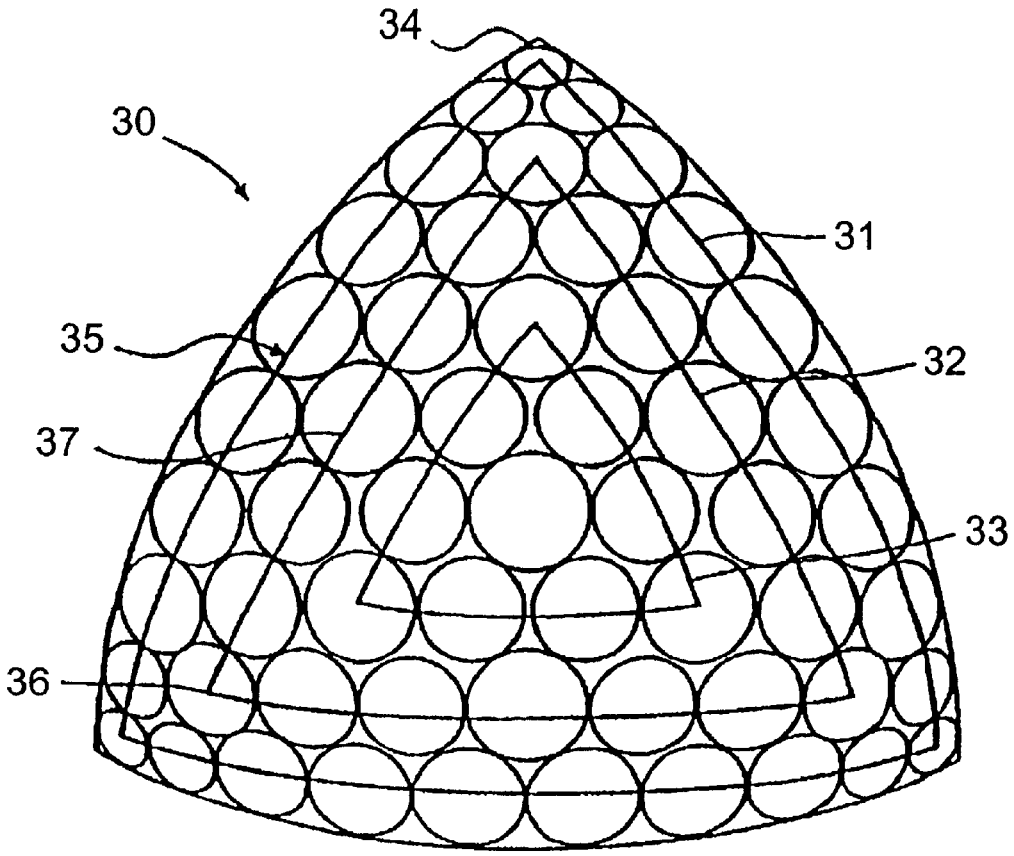
FIG. 15 is the spherical triangular region of FIG. 14, showing the triangular dimple arrangement.
Figure 17:
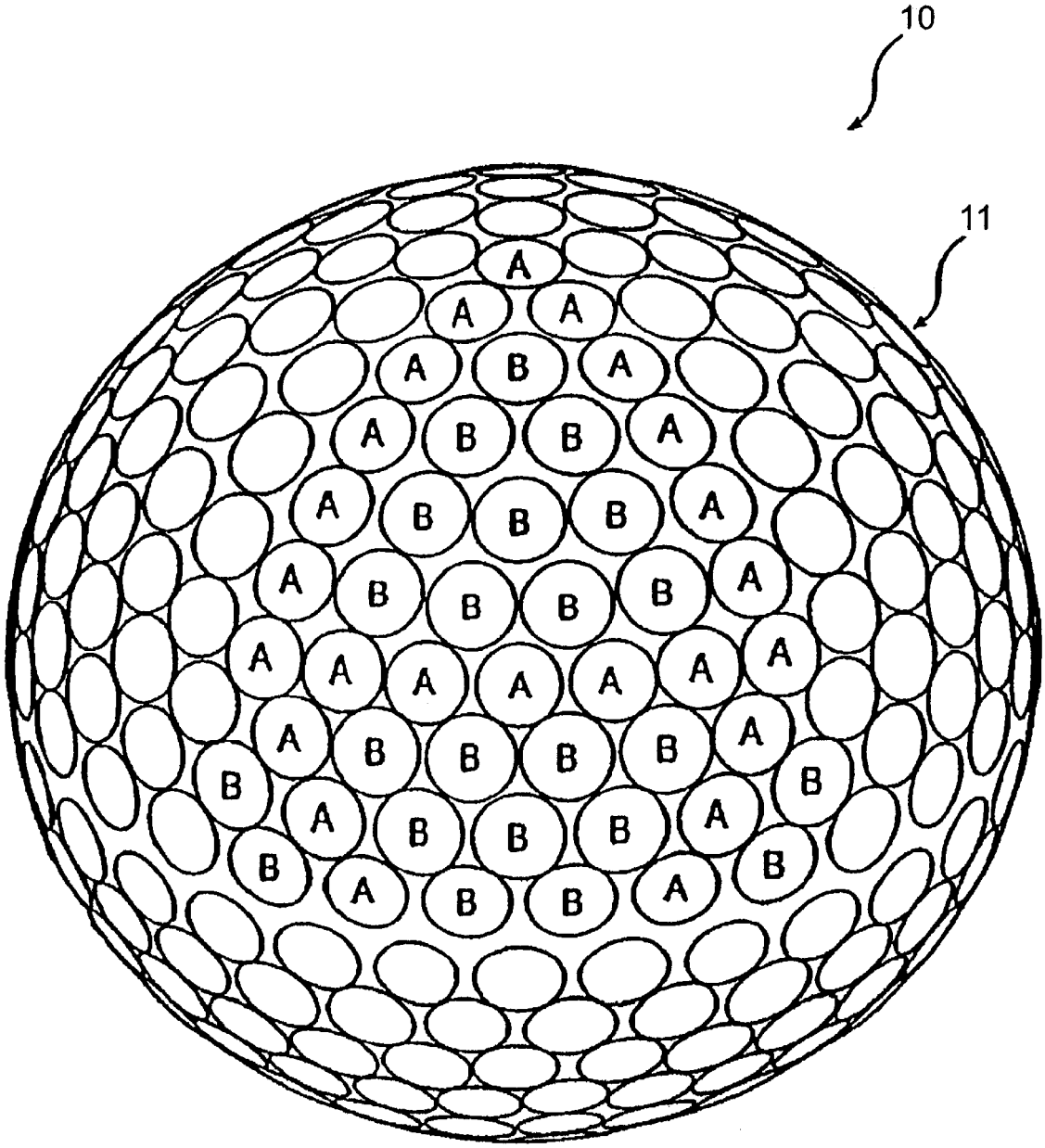
FIG. 17 is an isometric view of the icosahedron pattern used on the prior art TITLEIST PROFESSIONAL ball showing dimple sizes.
Figure 18:
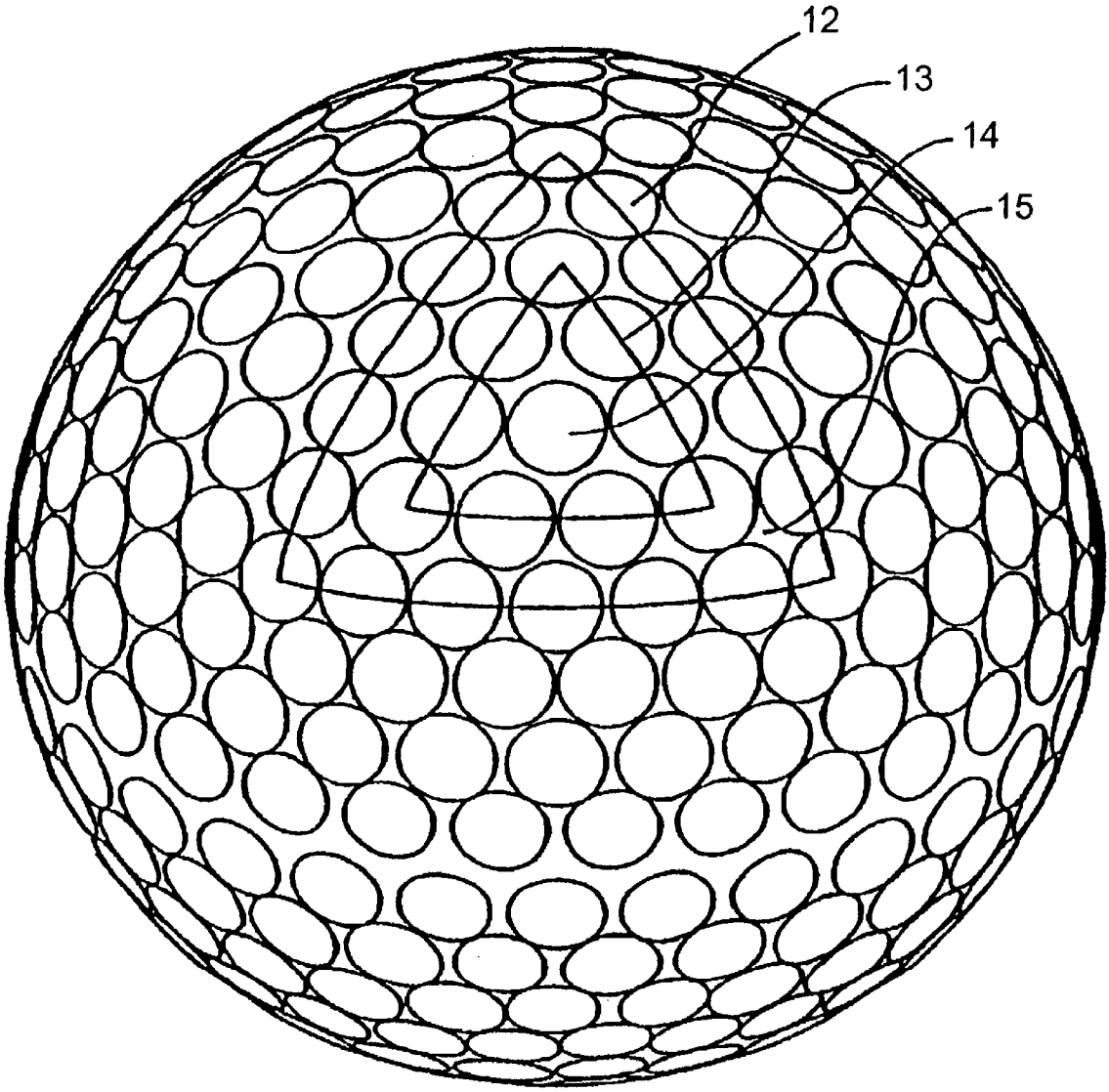
FIG. 18 is an isometric view of the icosahedron pattern used on the prior art TITLEIST PROFESSIONAL ball showing the triangular regions formed by the icosahedron pattern.

There is a significant increase in surface area contemplated for the golf balls of the present invention as compared to prior art golf balls. For example, FIGS. 17–18 show the TITLEIST PROFESSIONAL golf ball 10 with less than 80 percent of its surface covered by dimples. In contrast, one embodiment of the present invention contemplates dimple coverage of greater than about 80 percent. For example, the percentages of surface area covered by dimples in the embodiments shown in FIGS. 8–9 and 10–13 are about 85.7 percent and 82 percent, respectively. The percentage of surface area covered by dimples in the third embodiment shown in FIGS. 14–15 is also about 82 percent, whereas prior art octahedral balls have less than 77 percent of their surface covered by dimples, and most have less than 60 percent.

This higher coverage may be attributed to the different sizes of dimples contained on a golf ball of the present invention in comparison with the TITLEIST PROFESSIONAL ball in FIGS. 17–18. For example, the TITLEIST PROFESSIONAL ball has a plurality of dimples 11 on the outer surface that are formed into a dimple pattern having two sizes of dimples. The first set of dimples A have diameters of about 0.14 inches and form the outer triangle 12 of the icosahedron dimple pattern. The second set of dimples B have diameters of about 0.16 inches and form the inner triangle 13 and the center dimple 14. The dimples 11 cover less than 80 percent of the outer surface of the golf ball and there are a significant number of large spaces 15 between adjacent dimples, i.e., spaces that could hold a dimple of 0.03 inches diameter or greater.

Similarly, FIGS. 8–9 and 10–13 also employ dimple packing based on an icosahedron pattern. In contrast to the TITLEIST PROFESSIONAL ball shown in FIGS. 17–18, however, the first and second dimple patterns used with the present invention (FIGS. 8–9 and 10–13) both contain more than two different sizes of dimples.

In an icosahedron pattern, there are twenty triangular regions that are generally formed from the dimples. The icosahedron pattern has five triangles formed at both the top and bottom of the ball, each of which shares the pole dimple as a point. Each of the sides of the large triangles are formed from an odd number of dimples and each of the side of the small triangles are formed with an even number of dimples.

In the icosahedron pattern shown in FIGS. 8–9 and 10–13, there are seven dimples along each of the sides of the large triangle 22 and four dimples along each of the sides of the small triangle 23. Thus, the large triangle 22 has nine more dimples than the small triangle 23, which creates hexagonal packing 26, i.e., each dimple is surrounded by six other dimples for most of the dimples on the ball. For example, the center dimple, DE, is surrounded by six dimples slightly smaller, $D_D$. In one embodiment, at least 75 percent of the dimples have 6 adjacent dimples. In another embodiment, only the dimples forming the points of the large triangle 25, $D_A$, do not have hexagonal packing. Since dimples $D_A$ are smaller than the adjacent dimples, the gaps between adjacent dimples are surprisingly small.

The golf ball 20 has a greater dispersion of the largest dimples. For example, in FIG. 8, there are four of the largest diameter dimples, DE, located in the center of the triangles and at the mid-points of the triangle sides. Thus, there are no two adjacent dimples of the largest diameter. This improves dimple packing and aerodynamic uniformity. Similarily, in FIG. 10, there is only one largest diameter dimple, $D_E$, which is located in the center of the triangles. Even the next to the largest dimples, $D_D$ are dispersed at the mid-points of the large triangles such that there are no two adjacent dimples of the two largest diameters, except where extra dimples have been added along the equator.

As used herein, adjacent dimples can be considered as any two dimples where the two tangent lines from the first dimple that intersect the center of the second dimple do not intersect any other dimple. In one embodiment, less than 30 percent of the gaps between adjacent dimples is greater than 0.01 inches. In another embodiment, less than 15 percent of the gaps between adjacent dimples is greater than 0.01 inches.

In the first dimple pattern embodiment (FIGS. 8–9), there are five different sized dimples A–E, wherein dimples E ($D_E$) are greater than dimples D ($D_D$), which are greater than dimples C ($D_C$), which are greater than dimples B ($D_B$), which are greater than dimples A ($D_A$); $D_E$ $>D_D>D_C>D_B>D_A$. Dimple minimum sizes according to this embodiment are set forth in Table 6 below:

TABLE 6

| Dimple Sizes for First Dimple Pattern Embodiment | |
|---|---|
| Dimple | Percent of Ball Diameter |
| A | 6.55 |
| B | 8.33 |
| C | 9.52 |
| D | 10.12 |
| E | 10.71 |

The dimples of this embodiment are formed in large triangles 22 and small triangles 23. The dimples along the sides of the large triangle 22 increase in diameter toward the midpoint 24 of the sides. The largest dimple along the sides, $D_E$, is located at the midpoint 24 of each side of the large triangle 22, and the smallest dimples, $D_A$, are located at the triangle points 25. In this embodiment, each dimple along the sides is larger than the adjacent dimple toward the triangle point.

In the second dimple pattern embodiment illustrated in FIGS. 10–13, there are again five different sized dimples A–E, wherein dimples E ($D_E$) are greater than dimples D ($D_D$), which are greater than dimples C ($D_C$), which are greater than dimples B($D_B$), which are greater than dimples A ($D_A$); $D_E>D_D>D_C>D_B>D_A$. Dimple minimum sizes according to this embodiment are set forth in Table 7 below:

TABLE 7

| Dimple Sizes for Second Dimple Pattern Embodiment | |
|---|---|
| Dimple | Percent of Ball Diameter |
| A | 6.55 |
| B | 8.93 |
| C | 9.23 |
| D | 9.52 |
| E | 10.12 |

Figure 12:
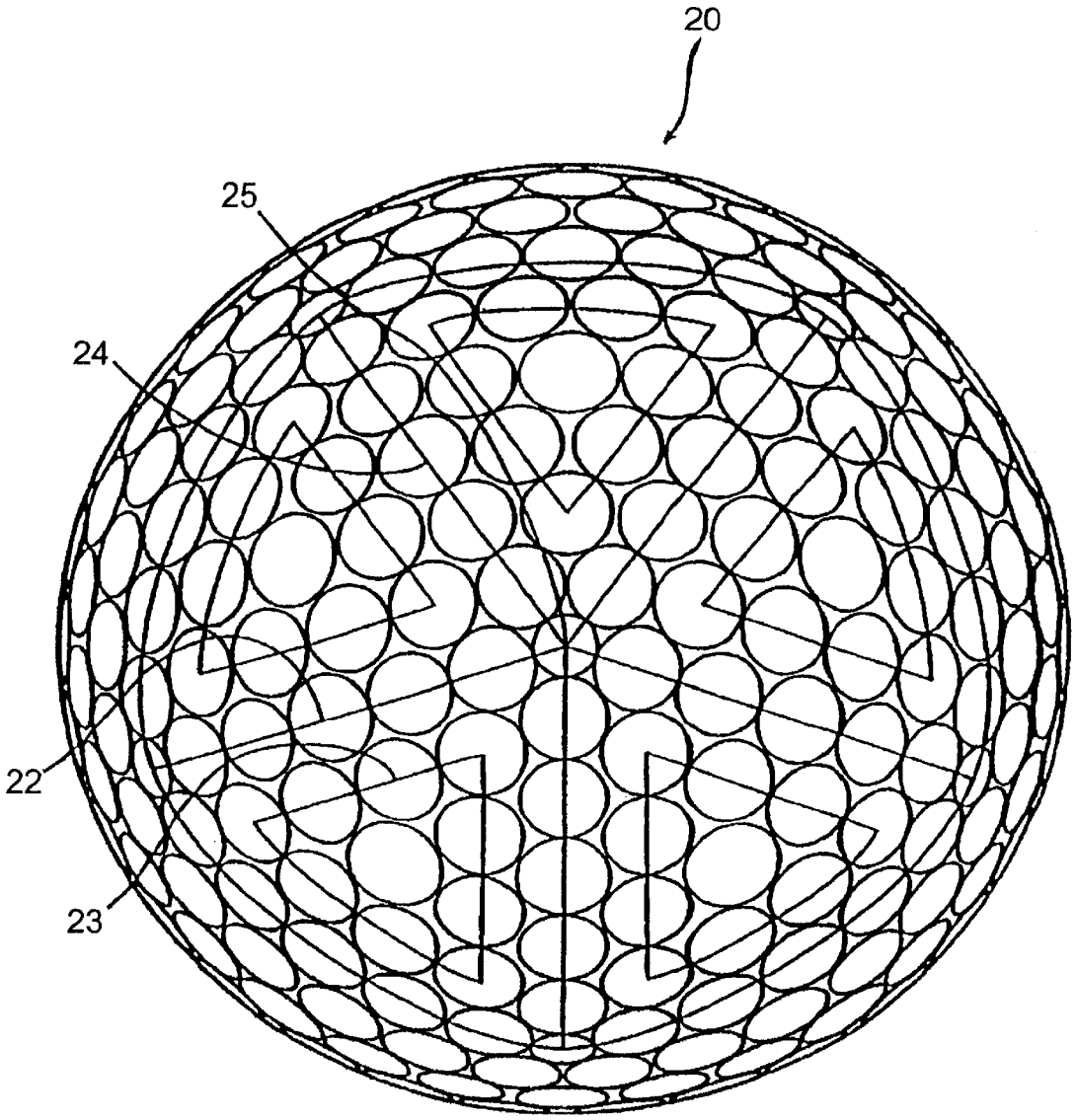
FIG. 12 is another top view of the golf ball in FIG. 10, showing dimple arrangement

In the second dimple pattern embodiment, the dimples are again formed in large triangles 22 and small triangles 23 as shown in FIG. 12. The dimples along the sides of the large triangle 22 increase in diameter toward the midpoint 24 of the sides. The largest dimple along the sides, $D_D$, is located at the midpoint 24 of each side of the large triangle 22, and the smallest dimples, $D_A$, are located at the triangle points 25. In this embodiment, each dimple along the sides is larger than the adjacent dimple toward the triangle point, i.e., $D_B>D_A$ and $D_D>D_B$.

A third dimple pattern embodiment having an octahedral dimple pattern is illustrated in FIGS. 14–15. In the octahedral dimple pattern shown in FIG. 15, for example, there are eight spherical triangular regions 30 that form the ball. Each of the sides of the large triangle 31 has an even number of dimples, each of the sides of the small triangle 32 has an odd number of dimples and each of the sides of the smallest triangle 33 has an even number of dimples. There are ten dimples along the sides of the large triangles 31, seven dimples along the sides of the small triangles 32, and four dimples along the sides of the smallest triangles 33. Thus, the large triangle 31 has nine more dimples than the small triangle 32 and the small triangle 32 has nine more dimples than the smallest triangle 33. This creates the hexagonal packing for all of the dimples inside of the large triangles 31.

In this third dimple pattern embodiment, there are six different sized dimples A–F, wherein dimples F ($D_F$) are greater than dimples E ($D_E$), which are greater than dimples D ($D_D$), which are greater than dimples C ($D_C$), which are greater than dimples B($D_B$), which are greater than dimples A ($D_A$); $DF>D_E>D_D>D_C>D_B>D_A$. Dimple minimum sizes according to this embodiment are set forth in Table 8 below:

TABLE 8

| Dimple Sizes for Third Dimple Pattern Embodiment | |
|---|---|
| Dimple | Percent of Ball Diameter |
| A | 5.36 |
| B | 6.55 |
| C | 8.33 |
| D | 9.83 |
| E | 9.52 |
| F | 10.12 |

In this third dimple pattern embodiment, the dimples are formed in large triangles 31, small triangles 32 and smallest triangles 33. Each dimple along the sides of the large triangle 31 is equal to or larger than the adjacent dimple from the point 34 to the midpoint 35 of the triangle 31. The dimples at the midpoint 35 of the side, $D_E$, are the largest dimples along the side and the dimples at the points 34 of the triangle, $D_A$, are the smallest. In addition, each dimple along the sides of the small triangle 32 is also equal to or larger than the adjacent dimple from the point 36 to the midpoint 37 of the triangle 32. The dimple at the midpoint 37 of the side, $D_F$, is the largest dimple along the side and the dimples at the points 36 of the triangle, $D_C$, are the smallest.

In one embodiment of the present invention, the golf balls include a dimple pattern containing at least one parting line, or annular region. A parting line, or annular region, about the equator of a golf ball has been found to separate the flow profile of the air into two distinct halves while the golf ball is in flight and reduce the aerodynamic force associated with pressure recovery, thus improving flight distance and roll. The parting line must coincide with the axis of ball rotation. It is possible to manufacture a golf ball without parting line, however, most balls have one for ease of manufacturing, e.g., buffing of the golf balls after molding, and many players prefer to have a parting line to use as an alignment aid for putting.

Figure 8:
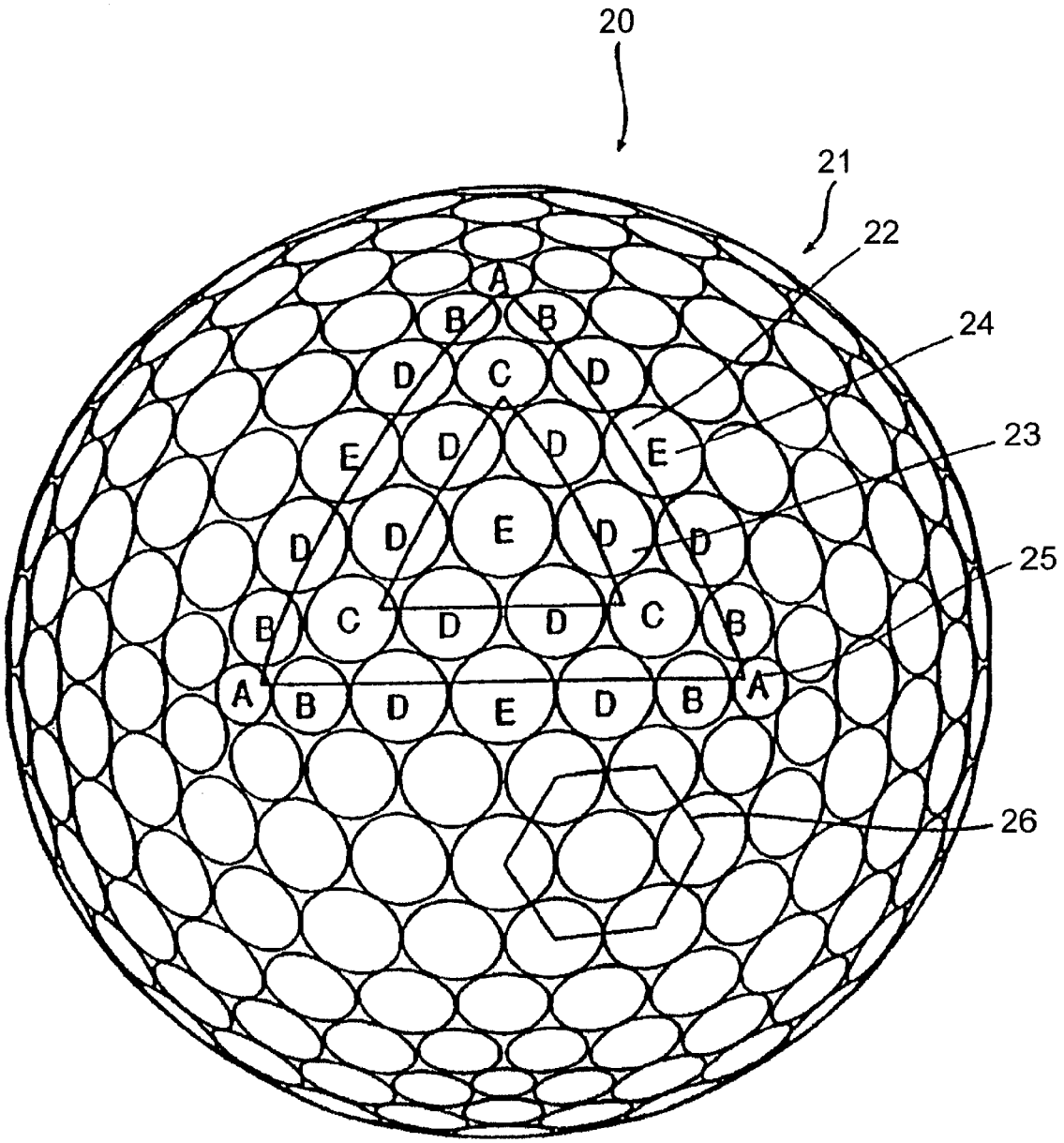
FIG. 8 is an isometric view of a first embodiment of a golf ball according to the present invention having an icosahedron pattern, showing dimple sizes.
Figure 9:
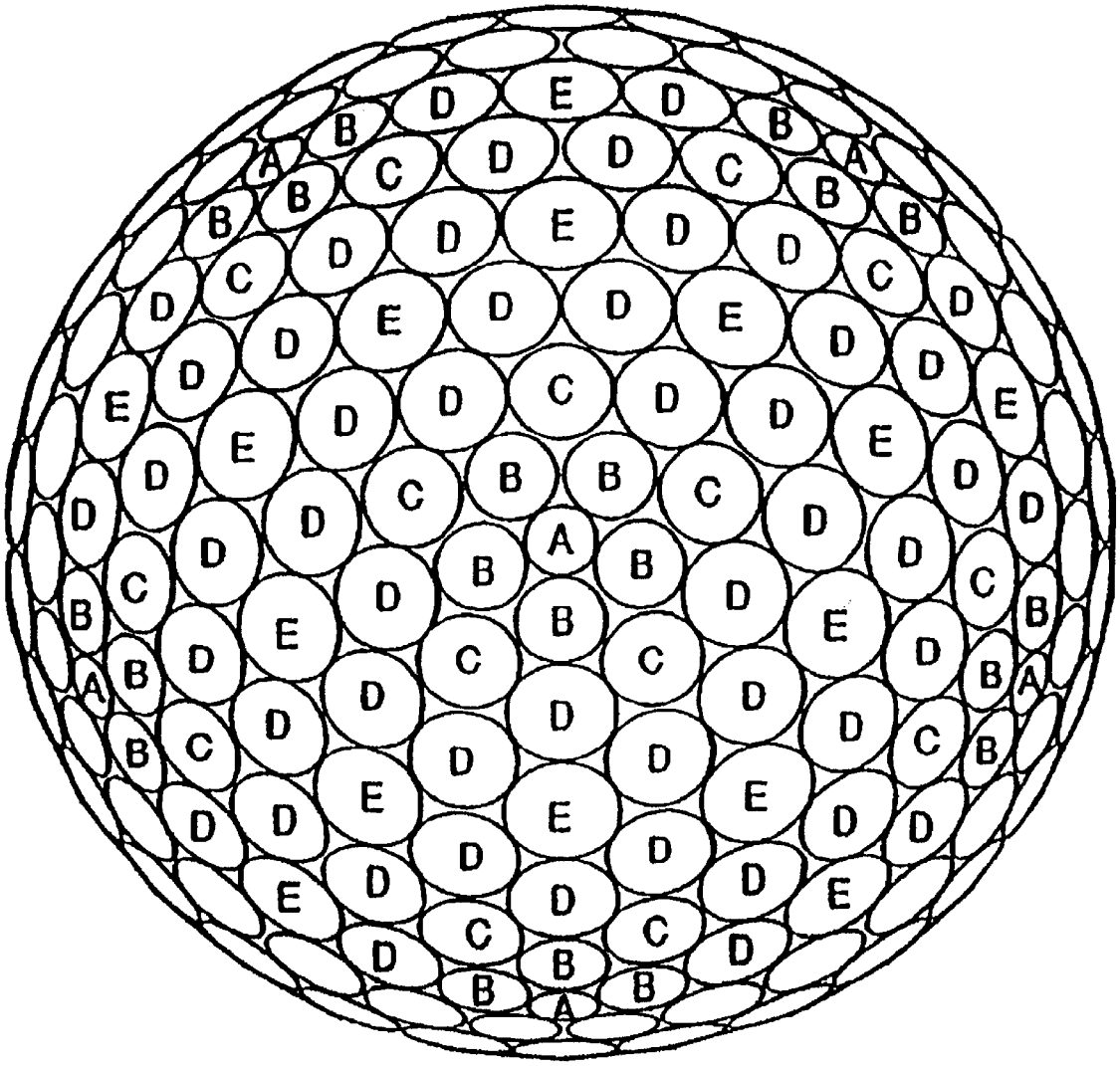
FIG. 9 is a top view of the golf ball in FIG. 8, showing dimple sizes and arrangement.
Figure 10:
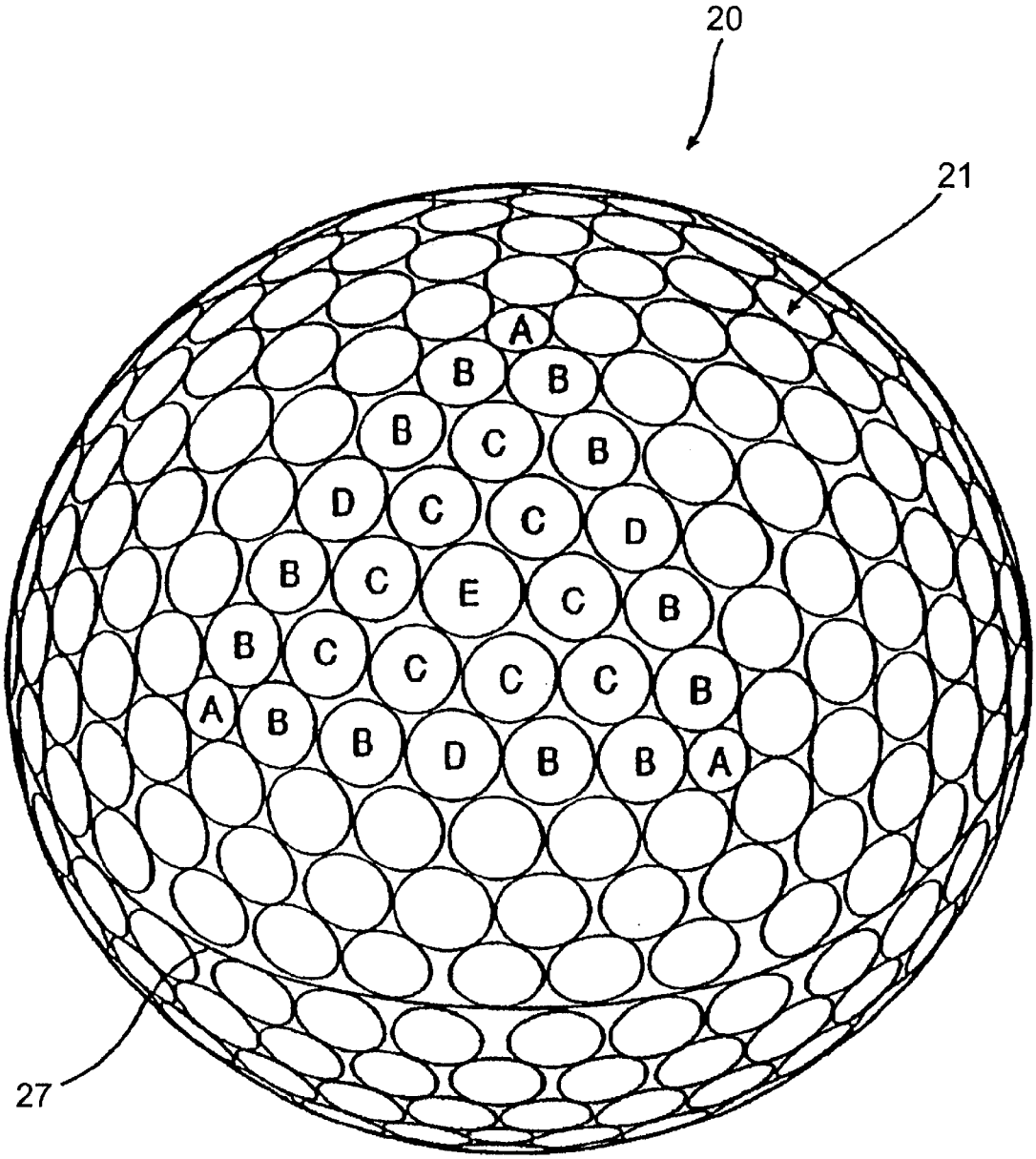
FIG. 10 is an isometric view of a second embodiment of a golf ball according to the present invention having an icosahedron pattern, showing dimple sizes and the triangular regions formed from the icosahedron pattern.
Figure 11:
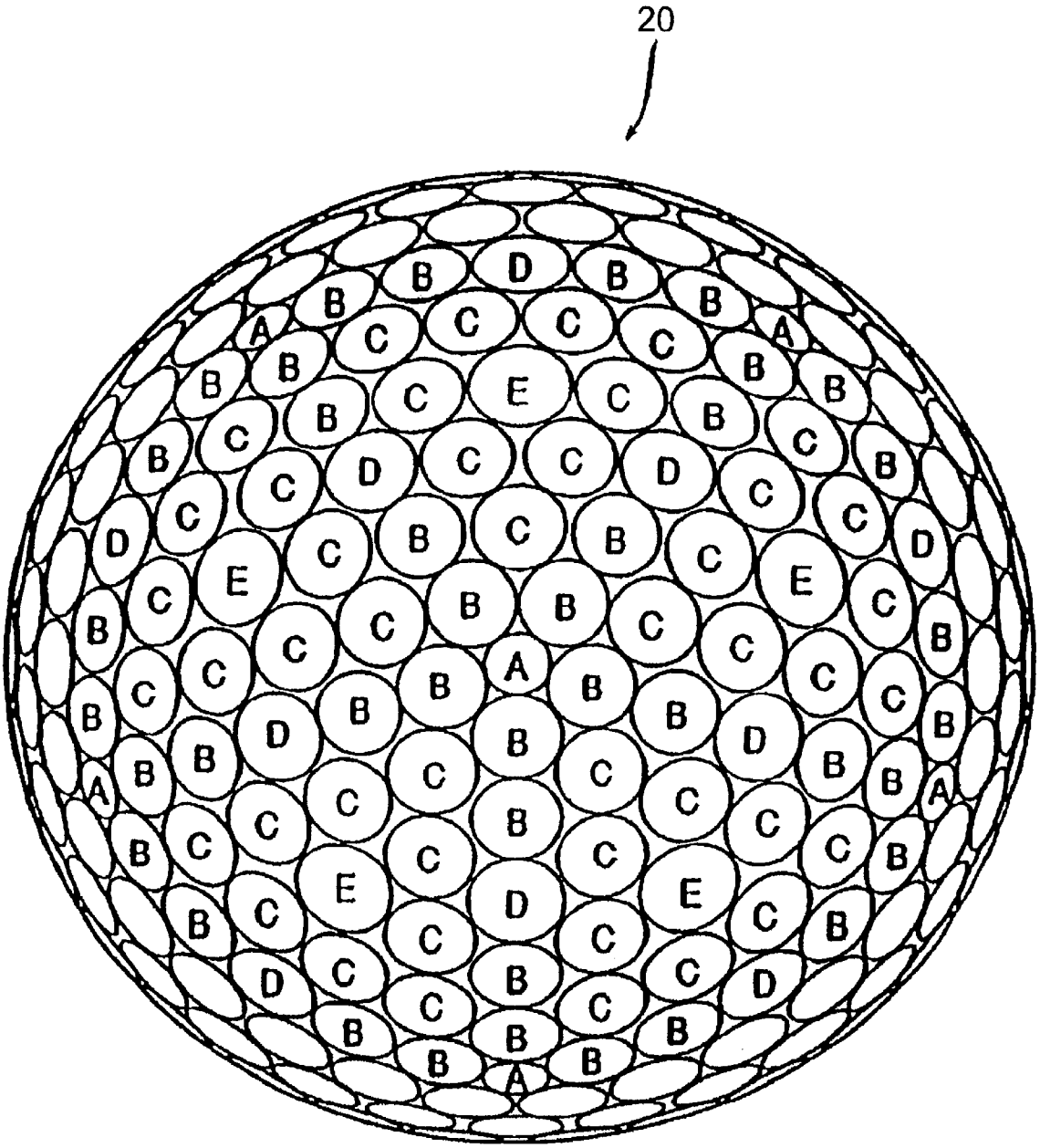
FIG. 11 is a top view of the golf ball in FIG. 10, showing dimple sizes and arrangement.

In another embodiment, there is no parting line that does not intersect any dimples, as illustrated in the golf ball shown in FIG. 8. While this increases the percentage of the outer surface that is covered by dimples, the lack of the parting line may make manufacturing more difficult.

In yet another embodiment, the parting line(s) may include regions of no dimples or regions of shallow dimples. For example, most icosahedron patterns generally have modified triangles around the mid-section to create a parting line that does not intersect any dimples. Referring specifically to FIG. 13, the golf ball in this embodiment has a modified icosahedron pattern to create the parting line 27, which is accomplished by inserting an extra row of dimples. In the triangular section identified with lettered dimples, there is an extra row 28 of D-C-C-D dimples added below the parting line 27. Thus, the modified icosahedron pattern in this embodiment has thirty more dimples than the unmodified icosahedron pattern in the embodiment shown in FIGS. 8–9.

In another embodiment, there are more than two parting lines that do not intersect any dimples. For example, the octahedral golf ball shown in FIGS. 14–15 contains three parting lines 38 that do not intersect any dimples. This decreases the percentage of the outer surface as compared to the first embodiment, but increases the symmetry of the dimple pattern. In another embodiment, the golf balls according to the present invention may have the dimples arranged so that there are less than four parting lines that do not intersect any dimples.

Ball Selection Based on Aerodynamic Forces

Figure 20:
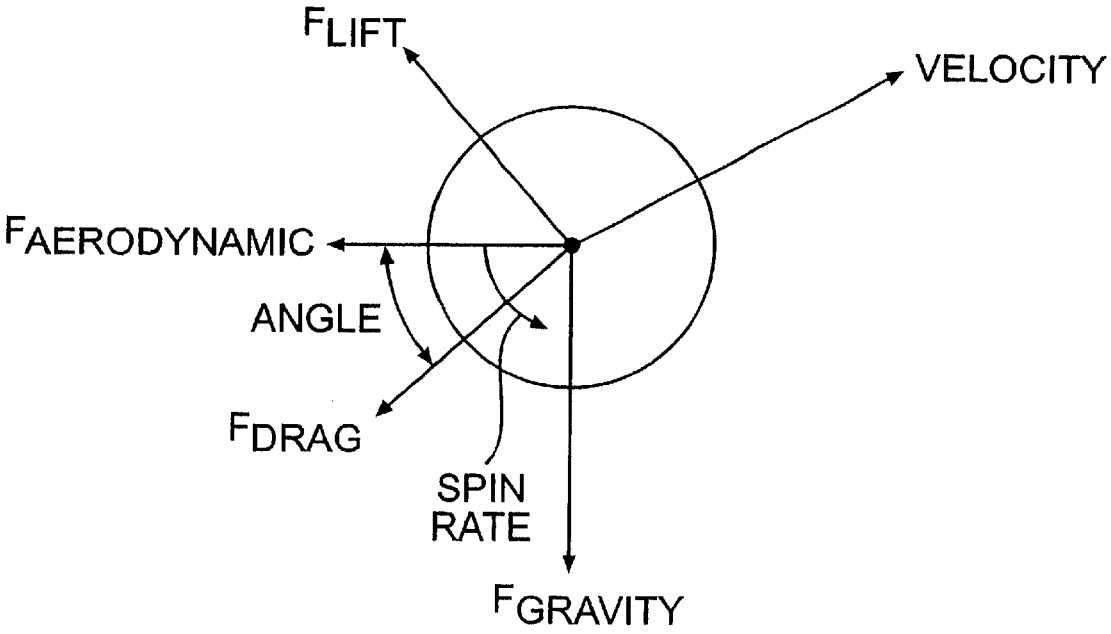
FIG. 20 is an illustration of the forces acting on a golf ball in flight.

Aerodynamic forces acting on a golf ball, typically resolved into orthogonal components of lift and drag may also be useful in matching a player with a particular swing speed with a specific golf ball. The forces acting on a golf ball in flight are enumerated in Equation 1 and illustrated in FIG. 20:

$$F=F_L+F_D+F_G \quad \text{(Eq. 1)}$$

Where F=total force acting on the ball $F_L$=lift force $F_D$=drag force $F_G$=gravity force Lift force ($F_L$) is defined as the aerodynamic force component acting perpendicular to the flight path resulting from a difference in pressure that is created by a distortion in the air flow that results from the back spin of the ball. Drag force ($F_D$) is defined as the aerodynamic force component acting parallel to the ball flight direction. The lift and drag forces of Equation 1 are calculated in Equations 2 and 3, respectively:

$$F_L=0.5C_L\rho AV^2 \quad \text{(Eq. 2)}$$

$$F_D=0.5C_D\rho AV^2 \quad \text{(Eq. 3)}$$

where ρ=density of air (slugs/ft$^3$)

A=projected area of the ball (ft$^2$) ($(\pi/4)D^2$)

D=ball diameter (ft)

V=ball velocity (ft/s)

$C_L$=dimensionless lift coefficient $C_D$=dimensionless drag coefficient

Lift and drag coefficients are used to quantify the force imparted to a ball in flight and are dependent on air density, air viscosity, ball speed, and spin rate; the influence of all these parameters may be captured by two dimensionless parameters Spin Ratio (SR) and Reynolds Number (NRe). Spin Ratio is the rotational surface speed of the ball divided by ball velocity. Reynolds Number quantifies the ratio of inertial to viscous forces acting on the golf ball moving through air. SR and NRe are calculated in Equations 4 and 5 below:

$$SR=\omega(D/2)/V \quad \text{(Eq. 4)}$$

$$N_{Re}=DV\rho/\mu \quad \text{(Eq. 5)}$$

where ω=ball rotation rate (radians/s) (2πr(RPS))

RPS=ball rotation rate (revolution/s)

V=ball velocity (ft/s)

D=ball diameter (ft)

ρ=air density (slugs/ft$^3$)

$\mu$=absolute viscosity of air (1b/ft-s)

There are a number of suitable methods for determining the lift and drag coefficients for a given range of SR and $N_{Re}$, which include the use of indoor test ranges with ballistic screen technology. U.S. Pat. No. 5,682,230, the entire disclosure of which is incorporated by reference herein, teach the use of a series of ballistic screens to acquire lift and drag coefficients. U.S. Pat. Nos. 6,186,002 and 6,285,445, also incorporated in their entirety by reference herein, disclose methods for determining lift and drag coefficients for a given range of velocities and spin rates using an indoor test range, wherein the values for $C_L$ and $C_D$ are related to SR and $N_{Re}$ for each shot. One skilled in the art of golf ball aerodynamics testing could readily determine the lift and drag coefficients through the use of an indoor test range.

Figure 21:
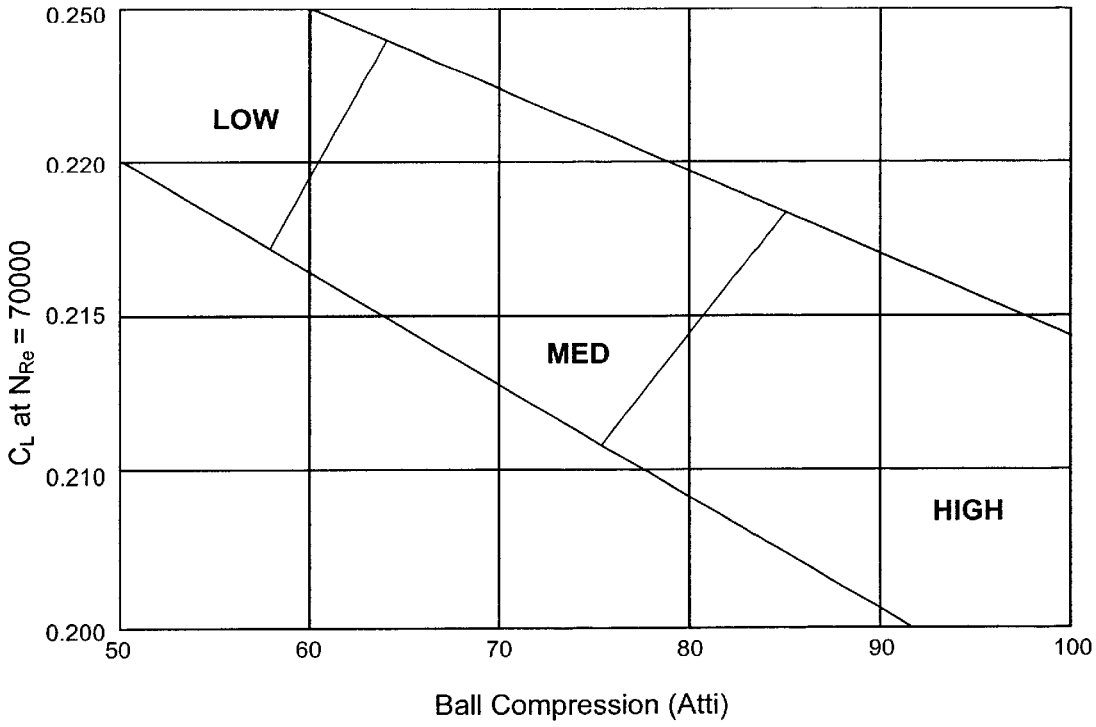
FIG. 21 is a chart correlating ball compression and lift coefficient with golfer swing speed.
Figure 22:
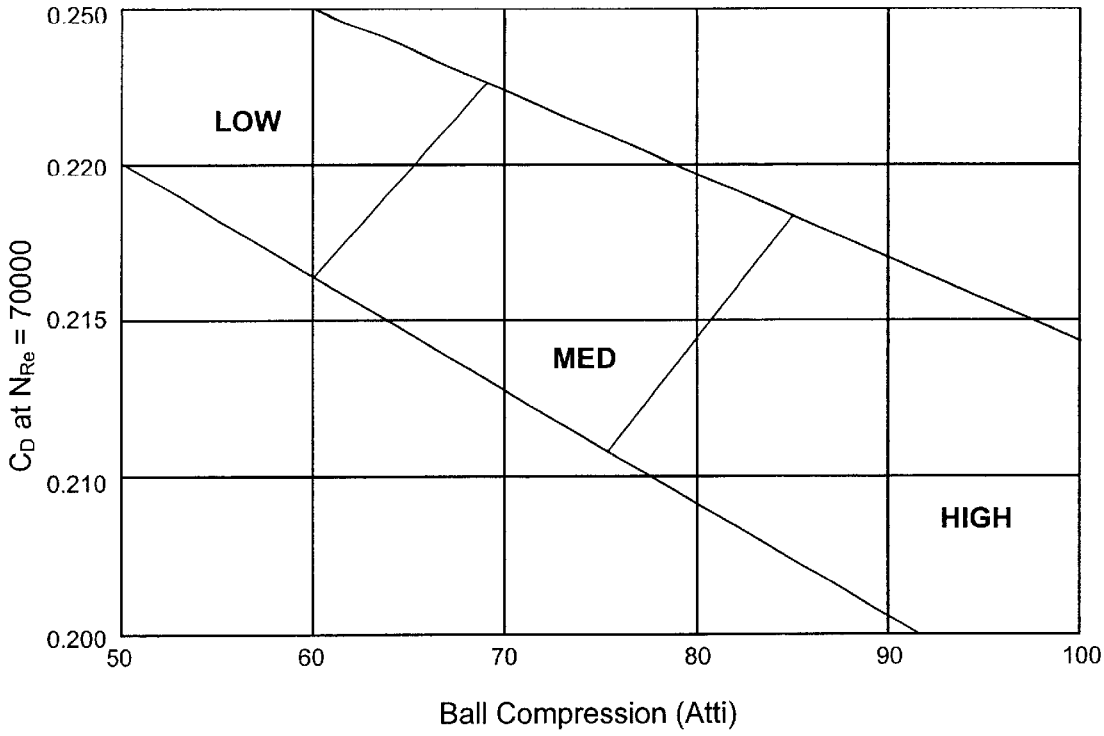
FIG. 22 is a chart correlating ball compression and drag coefficient with golfer swing speed.

A golf ball may be selected for a particular golfer based on lift coefficient by using a direct linear relationship between the lift coefficient and the golfer's swing speed, as shown in FIG. 21. In addition, as illustrated in FIG. 22, a direct linear relationship between a golf ball's drag coefficient and the golfer's swing speed allows the selection of a golf ball based on the drag coefficient. The linear relationship may be determined by providing a number of golf balls having predetermined lift and drag coefficients, as described above, and matching those balls to particular swing speeds as shown by the upper and lower boundaries set forth in FIGS. 21–22. The present invention is generally directed though to fitting a golfer to a ball that generally comes with different lift and drag coefficients as set forth by the ball manufacturer and then the lift and/or drag coefficient is matched to a particular swing speed.

As shown in FIG. 21, using a lift coefficient corresponding to a Reynold's number of 70,000, a lower swing speed player is best matched to a ball having a higher lift coefficient than a high swing speed player.

FIGS. 21 and 22 may also be representative of the relationship between high, medium, and low ball speeds and ball compression and lift and drag coefficients. For example, FIG. 21 may be used, once the ball speed is known, to choose the optimum ball compression and/or lift coefficient based on the relationship between the characteristics. In addition, FIG. 22 may be interpreted to be a correlation between high, medium, and low ball speed and ball compression and the drag coefficient. After the ball speed is determined, the relationship between ball speed and ball compression and drag will allow matching of a particular player with a particular ball and/or club.

A golf ball for use with the present invention may also initially defined by two novel parameters that account for both lift and drag simultaneously: 1) the magnitude of aerodynamic force ($C_{mag}$); and 2) the direction of the aerodynamic force (Angle). It has now been discovered that flight performance improvements are attained when the dimple pattern and dimple profiles are selected to satisfy specific magnitude and direction criteria. The magnitude and angle of the aerodynamic force are linearly related to the lift and drag coefficients and, therefore, the magnitude and angle of the aerodynamic coefficients are used to establish the preferred criteria. The magnitude and the angle of the aerodynamic coefficients are defined in Equations 6 and 7 below $$C_{mag}=\sqrt{(C_L^2+C_D^2)} \quad \text{(Eq. 6)}$$

$$\text{Angle}=\tan^{-1}(C_L/C_D) \quad \text{(Eq. 7)}$$

Table 9 illustrates the aerodynamic criteria for a golf ball used with the present invention that results in increased flight distances for any swing speed. The criteria are specified as low, median, high $C_{mag}$ and Angle for eight specific combinations of SR and $N_{Re}$. Golf balls with $C_{mag}$ and Angle values between the low and the high number are preferred. More preferably, the golf balls of the invention have $C_{mag}$ and Angle values between the low and the median numbers delineated in Table 9. The $C_{mag}$ values delineated in Table 9 are intended for golf balls that conform to USGA size and weight regulations. The size and weight of the golf balls used with the aerodynamic criteria of Table 1 are 1.68 inches and 1.62 ounces, respectively.

TABLE 9

Aerodynamic Characteristics
Ball Diameter = 1.68 inches, Ball Weight = 1.62 ounces

| | | Magnitude[1] | | | Angle[2] (°) | | |
|---|---|---|---|---|---|---|---|
| $N_{Re}$ | SR | Low | Median | High | Low | Median | High |
| 230000 | 0.085 | 0.24 | 0.265 | 0.27 | 31 | 33 | 35 |
| 207000 | 0.095 | 0.25 | 0.271 | 0.28 | 34 | 36 | 38 |
| 184000 | 0.106 | 0.26 | 0.280 | 0.29 | 35 | 38 | 39 |
| 161000 | 0.122 | 0.27 | 0.291 | 0.30 | 37 | 40 | 42 |
| 138000 | 0.142 | 0.29 | 0.311 | 0.32 | 38 | 41 | 43 |
| 115000 | 0.170 | 0.32 | 0.344 | 0.35 | 40 | 42 | 44 |
| 92000 | 0.213 | 0.36 | 0.390 | 0.40 | 41 | 43 | 45 |
| 69000 | 0.284 | 0.40 | 0.440 | 0.45 | 40 | 42 | 44 |

[1]As defined by Eq. 6
[2]As defined by Eq. 7

To ensure consistent flight performance regardless of ball orientation, the percent deviation of $C_{mag}$ for each of the SR and $N_{Re}$ combinations listed in Table 9 plays an important role. The percent deviation of $C_{mag}$ may be calculated in accordance with Equation 8, wherein the ratio of the absolute value of the difference between the $C_{mag}$ for two orientations to the average of the $C_{mag}$ for the two orientations is multiplied by 100.

$$\text{Percent deviation } C_{mag} = |(C_{mag1} - C_{mag2})| / ((C_{mag1} + C_{mag2})/2) * 100 \quad \text{(Eq. 8)}$$

where $C_{mag1} = C_{mag}$ for orientation 1
$C_{mag2} = C_{mag}$ for orientation 2

In one embodiment, the percent deviation is about 6 percent or less. In another embodiment, the deviation of $C_{mag}$ is about 3 percent or less. To achieve the consistent flight performance, the percent deviation criteria of Equation 8 is preferably satisfied for each of the eight $C_{mag}$ values associated with the eight SR and $N_{Re}$ values contained in Table 9.

In addition, to create a ball that adheres to the Rules of Golf, as approved by the United States Golf Association, the ball must not be designed, manufactured or intentionally modified to have properties that differ from those of a spherically symmetrical ball. Aerodynamic symmetry allows the ball to fly with little variation no matter how the golf ball is placed on the tee or ground. Thus, dimple patterns are preferably designed to cover the maximum surface area of the golf ball without detrimentally affecting the aerodynamic symmetry of the golf ball.

Figure 23:
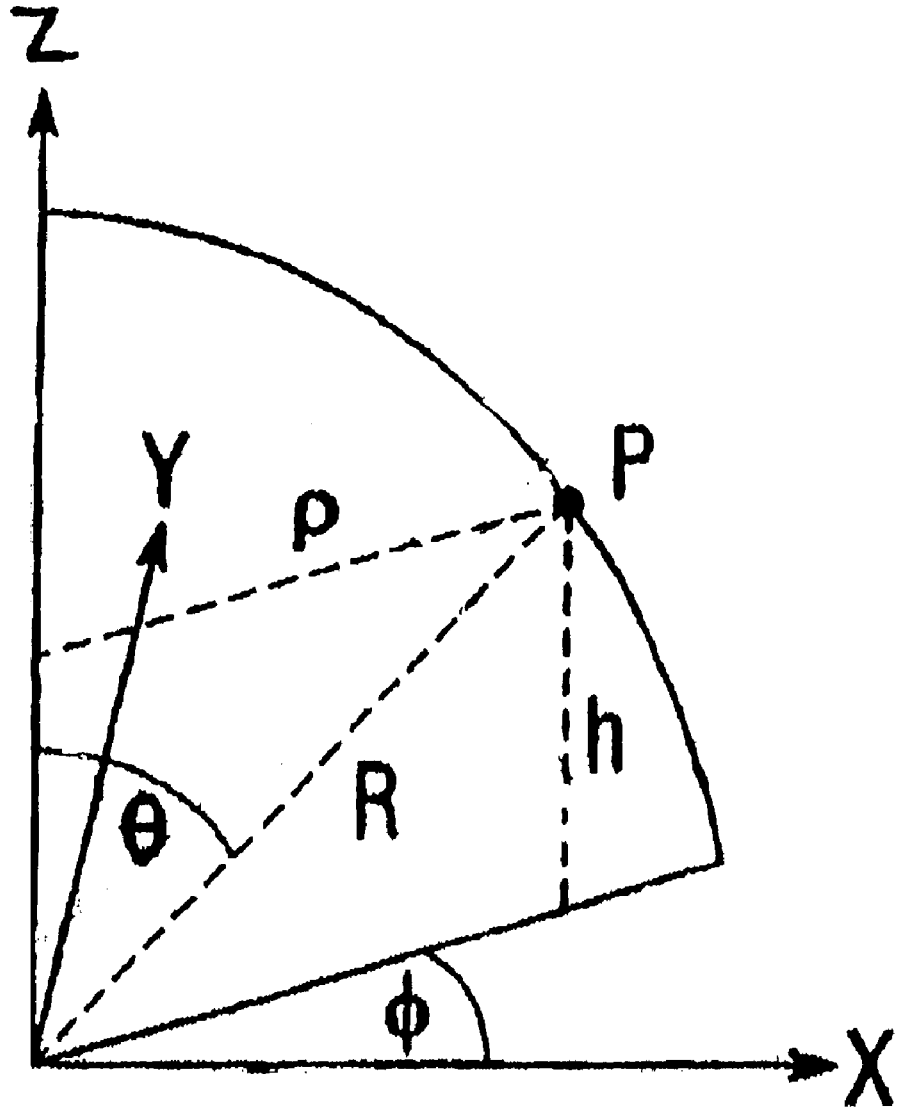
FIG. 23 is a graph illustrating the coordinate system in a dimple pattern according to one embodiment of the invention.

A representative coordinate system used to model some of the dimple patterns discussed above is shown in FIG. 23. The XY plane is the equator of the ball while the Z direction goes through the pole of the ball. Preferably, the dimple pattern is generated from the equator of the golf ball, the XY plane, to the pole of the golf ball, the Z direction.

As discussed above, golf balls containing dimple patterns having a parting line about the equator may result in orientation specific flight characteristics. The parting lines are generally desired by manufacturers for ease of production, as well as by many golfers for lining up a shot for putting or off the tee. The selective design of golf balls with dimple patterns including a parting line meeting the aerodynamic criteria set forth in Table 9 result in flight distances far improved over prior art. Geometrically, these parting lines should be orthogonal with the axis of rotation. However, in one embodiment of the present invention, there may be a plurality of parting lines with multiple orientations.

Aerodynamic asymmetry typically arises from parting lines inherent in the dimple arrangement or from parting lines associated with the manufacturing process. The percent $C_{mag}$ deviation should be obtained using $C_{mag}$ values measured with the axis of rotation normal to the parting line, commonly referred to as a poles horizontal, PH, orientation and $C_{mag}$ values measured in an orientation orthogonal to PH, commonly referred to as a pole over pole, PP orientation. The maximum aerodynamic asymmetry is generally measured between the PP and PH orientation.

One of ordinary skill in the art would be aware, however, that the percent deviation of $C_{mag}$ as outlined above applies to PH and PP, as well as any other two orientations. For example, if a particular dimple pattern is used having a great circle of shallow dimples, which will be described in greater detail below, different orientations should be measured. The axis of rotation to be used for measurement of symmetry in the above example scenario would be normal to the plane described by the great circle and coincident to the plane of the great circle.

In one embodiment, the aerodynamic coefficient magnitude for a golf ball varies less than about 6 percent whether a golf ball has a PH or PP orientation. In another embodiment, the variation of the aerodynamic coefficient magnitude between the two orientations is less than about 3 percent.

The $C^{mag}$ and Angle criteria delineated in Table 9 for golf balls with a nominal diameter of 1.68 and a nominal weight of 1.62 ounces may be advantageously scaled to obtain the similar optimized criteria for golf balls of any size and weight. The aerodynamic criteria of Table 9 may be adjusted to obtain the $C_{mag}$ and angle for golf balls of any size and weight in accordance with Equations 9 and 10.

$$C_{mag(ball)} = C_{mag(Table\ 1)} \sqrt{((\sin(\text{Angle}_{(Table\ 1)}) * (W_{ball}/1.62) * (1.68/D_{ball})^2)^2 + (\cos(\text{Angle}_{(Table\ 1)})^2)} \quad \text{(Eq. 9)}$$

$$\text{Angle}_{(ball)} = \tan^{-1}(\tan(\text{Angle}_{(Table\ 1)}) * (W_{ball}/1.62) * (168/D_{ball})^2) \quad \text{(Eq. 10)}$$

For example, Table 10 illustrates aerodynamic criteria for balls with a diameter of 1.60 inches and a weight of 1.7 ounces as calculated using Table 9, ball diameter, ball weight, and Equations 9 and 10.

TABLE 10

Aerodynamic Characteristics
Ball Diameter = 1.60 inches, Ball Weight = 1.70 ounces

| | | Magnitude[1] | | | Angle[2] (°) | | |
|---|---|---|---|---|---|---|---|
| $N_{Re}$ | SR | Low | Median | High | Low | Median | High |
| 230000 | 0.085 | 0.24 | 0.265 | 0.27 | 31 | 33 | 35 |
| 207000 | 0.095 | 0.262 | 0.287 | 0.297 | 38 | 40 | 42 |
| 184000 | 0.106 | 0.271 | 0.297 | 0.308 | 39 | 42 | 44 |
| 161000 | 0.122 | 0.83 | 0.311 | 0.322 | 42 | 44 | 46 |
| 138000 | 0.142 | 0.304 | 0.333 | 0.346 | 43 | 45 | 47 |
| 115000 | 0.170 | 0.337 | 0.370 | 0.383 | 44 | 46 | 49 |
| 92000 | 0.213 | 0.382 | 0.420 | 0.435 | 45 | 47 | 50 |
| 69000 | 0.284 | 0.430 | 0.473 | 0.489 | 44 | 47 | 49 |

[1]As defined by Eq. 9
[2]As defined by Eq. 10

Table 11 shows lift and drag coefficients ($C_L$, $C_D$), as well as $C_{mag}$ and Angle, for a golf ball having a normal diameter of 1.68 inches and a nominal weight of 1.61 ounces, with an icosahedron pattern with 392 dimples and two dimple diameters, of which the dimple pattern will be described in more detail below. The percent deviation in $C_{mag}$ for PP and PH ball orientations are also shown over the range of $N_{Re}$ and SR. The deviation in $C_{mag}$ for the two orientations over the entire range is less than about 3 percent.

TABLE 11

Aerodynamic Characteristics
Ball Diameter = 1.68 inches, Ball Weight = 1.61 ounces

| | | PP Orientation | | | | PH Orientation | | | | % Dev |
|---|---|---|---|---|---|---|---|---|---|---|
| $N_{Re}$ | SR | $C_L$ | $C_D$ | $C_{mag}$[1] | Angle[2] | $C_L$ | $C_D$ | $C_{mag}$[1] | Angle[2] | $C_{mag}$ |
| 230000 | 0.085 | 0.144 | 0.219 | 0.262 | 33.4 | 0.138 | 0.217 | 0.257 | 32.6 | 1.9 |
| 207000 | 0.095 | 0.159 | 0.216 | 0.268 | 36.3 | 0.154 | 0.214 | 0.264 | 35.7 | 1.8 |
| 184000 | 0.106 | 0.169 | 0.220 | 0.277 | 37.5 | 0.166 | 0.216 | 0.272 | 37.5 | 1.8 |
| 161000 | 0.122 | 0.185 | 0.221 | 0.288 | 39.8 | 0.181 | 0.221 | 0.286 | 39.4 | 0.9 |
| 138000 | 0.142 | 0.202 | 0.232 | 0.308 | 41.1 | 0.199 | 0.233 | 0.306 | 40.5 | 0.5 |
| 115000 | 0.170 | 0.229 | 0.252 | 0.341 | 42.2 | 0.228 | 0.252 | 0.340 | 42.2 | 0.2 |
| 92000 | 0.213 | 0.264 | 0.281 | 0.386 | 43.2 | 0.270 | 0.285 | 0.393 | 43.5 | 1.8 |
| 69000 | 0.284 | 0.278 | 0.305 | 0.413 | 42.3 | 0.290 | 0.309 | 0.423 | 43.2 | 2.5 |
| | | | SUM | 2.543 | | | SUM | 2.541 | | |

[1]As defined by Eq. 9
[2]As defined by Eq. 10

Table 12 shows lift and drag coefficients ($C_L$, $C_D$), as well as $C_{mag}$ and Angle for a prior golf ball having a nominal diameter of 1.68 inches and a nominal weight of 1.61 ounces. The percent deviation in $C_{mag}$ for PP and PH ball orientations are also shown over the range of $N_{Re}$ and SR. The deviation in $C_{mag}$ for the two orientations is greater than about 3 percent over the entire range, greater than about 6 percent for $N_{Re}$ of 161000, 138000, 115000, and 92000, and exceeds 10 percent at a $N_{Re}$ of 69000.

TABLE 12

Aerodynamic Characteristics For Prior Art Golf Ball
Ball Diameter = 1.68 inches, Ball Weight = 1.61 ounces

| | | PP Orientation | | | | PH Orientation | | | | % Dev |
|---|---|---|---|---|---|---|---|---|---|---|
| $N_{Re}$ | SR | $C_L$ | $C_D$ | $C_{mag}$[1] | Angle[2] | $C_L$ | $C_D$ | $C_{mag}$[1] | Angle[2] | $C_{mag}$ |
| 230000 | 0.085 | 0.151 | 0.222 | 0.269 | 34.3 | 0.138 | 0.219 | 0.259 | 32.3 | 3.6 |
| 207000 | 0.095 | 0.160 | 0.223 | 0.274 | 35.6 | 0.145 | 0.219 | 0.263 | 33.4 | 4.1 |
| 184000 | 0.106 | 0.172 | 0.227 | 0.285 | 37.2 | 0.154 | 0.221 | 0.269 | 34.8 | 5.6 |
| 161000 | 0.122 | 0.188 | 0.233 | 0.299 | 38.9 | 0.166 | 0.225 | 0.279 | 36.5 | 6.9 |
| 138000 | 0.142 | 0.209 | 0.245 | 0.322 | 40.5 | 0.184 | 0.231 | 0.295 | 38.5 | 8.7 |
| 115000 | 0.170 | 0.242 | 0.269 | 0.361 | 42.0 | 0.213 | 0.249 | 0.328 | 40.5 | 9.7 |
| 92000 | 0.213 | 0.280 | 0.309 | 0.417 | 42.2 | 0.253 | 0.283 | 0.380 | 41.8 | 9.5 |
| 69000 | 0.284 | 0.270 | 0.308 | 0.409 | 41.2 | 0.308 | 0.337 | 0.457 | 42.5 | 10.9 |
| | | | SUM | 2.637 | | | SUM | 2.531 | | |

[1]As defined by Eq. 9
[2]As defined by Eq. 10

Table 13 illustrates the flight performance of a golf ball of the present invention having a nominal diameter of 1.68 inches and weight of 1.61 ounces, compared to a prior art golf ball having similar diameter and weight. Each prior art ball is compared to a golf ball of the present invention at the same speed, angle, and back spin.

TABLE 13

Ball Flight Performance, Invention vs. Prior Art Golf Ball
Ball Diameter = 1.68 inches, Ball Weight = 1.61 ounces

| Ball | | Launch Conditions | | Rotation | Ball Flight | | |
|---|---|---|---|---|---|---|---|
| | Ball Orientation | Speed (mph) | Angle | Rate (rpm) | Distance (yds) | Time (s) | Impact Angle |
| Prior Art | PP | 168.4 | 8.0 | 3500 | 267.2 | 7.06 | 41.4 |
| | PH | 168.4 | 8.0 | 3500 | 271.0 | 6.77 | 36.2 |
| Invention | PP | 168.4 | 8.0 | 3500 | 276.7 | 7.14 | 39.9 |
| | PH | 168.4 | 8.0 | 3500 | 277.6 | 7.14 | 39.2 |
| Prior Art | PP | 145.4 | 8.0 | 3000 | 220.8 | 5.59 | 31.3 |
| | PH | 145.4 | 8.0 | 3000 | 216.9 | 5.18 | 25.4 |
| Invention | PP | 145.4 | 8.0 | 3000 | 226.5 | 5.61 | 29.3 |
| | PH | 145.4 | 8.0 | 3000 | 226.5 | 5.60 | 28.7 |

Table 13 shows an improvement in flight distance for a golf ball of the present invention of between about 6 to about 10 yards over a similar size and weight prior art golf ball. Table 13 also shows that the flight distance of prior art golf balls is dependent on the orientation when struck, i.e., a deviation between a PP and PH orientation results in about 4 yards distance between the two orientations. In contrast, golf balls of the present invention exhibit less than about 1 yard variation in flight distance due to orientation. Additionally, prior art golf balls exhibit large variations in the angle of ball impact with the ground at the end of flight, i.e., about 5°, for the two orientations, while golf balls of the present invention have a variation in impact angles for the two orientations of less than about 1°. A large variation in impact angle typically leads to significantly different amounts of roll when the ball strikes the ground.

Figure 24:
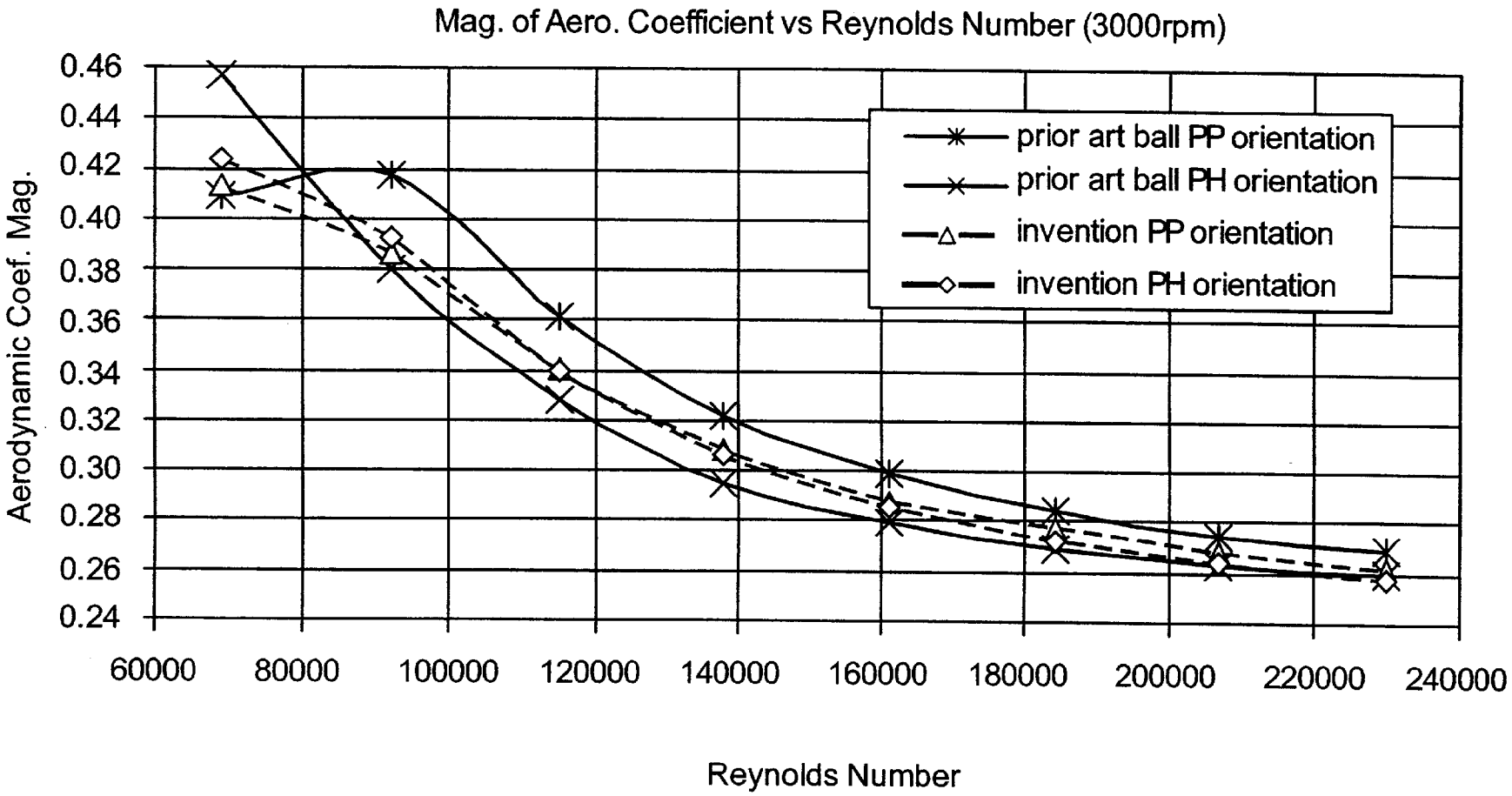
FIG. 24 is a graph of the magnitude of aerodynamic coefficients versus Reynolds Number for a golf ball made according to the present invention and a prior art golf ball.
Figure 25:
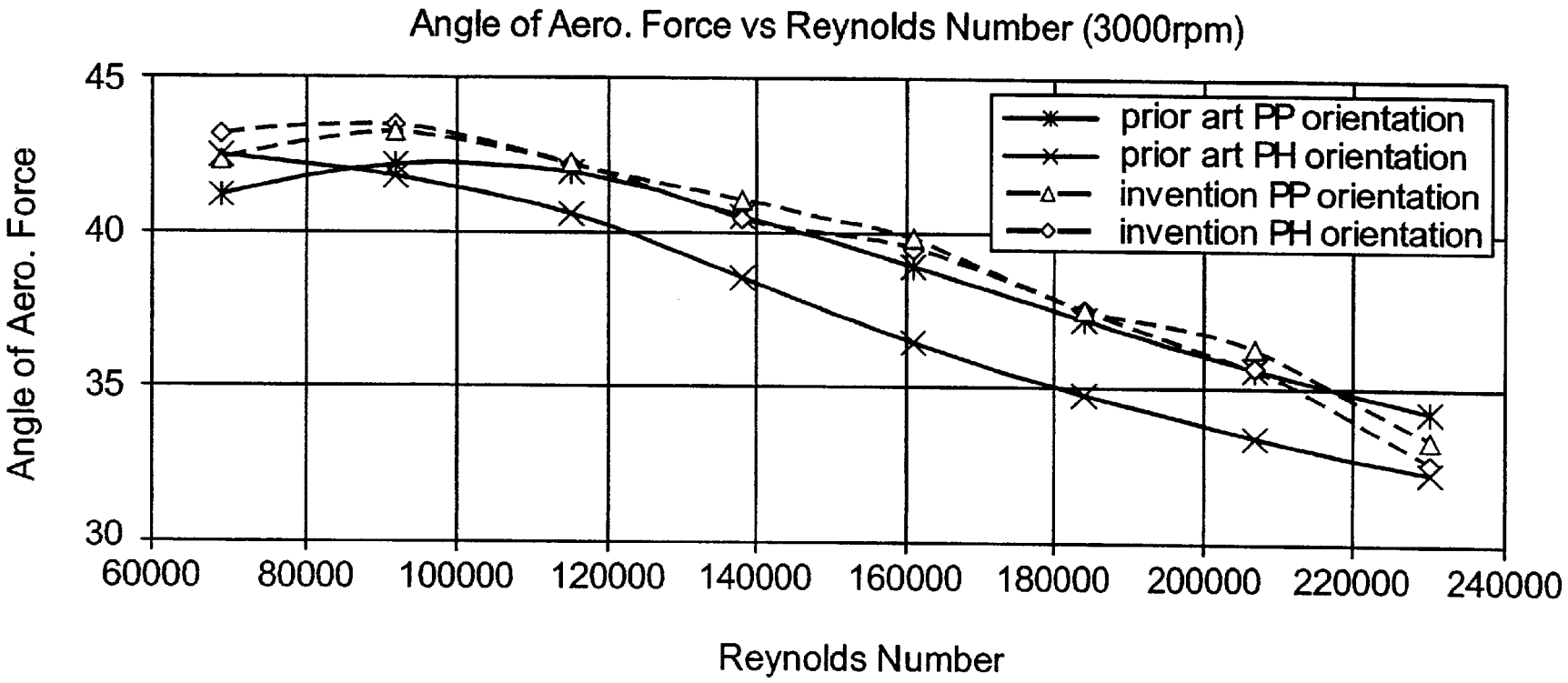
FIG. 25 is a graph of the angle of aerodynamic force versus Reynolds Number for a golf ball made according to the present invention and a prior art golf ball.

The advantageously consistent flight performance of a golf ball of the present invention, i.e., the less variation in flight distance and impact angle, results in more accurate play and potentially yields lower golf scores. FIGS. 24–25 illustrate the magnitude of the aerodynamic coefficients and the angle of aerodynamic force plotted versus $N_{Re}$ for a golf ball of the present invention and a prior art golf ball, each having a diameter of about 1.68 inches and a weight of about 1.61 ounces with a fixed spin rate of 3000 rpm. As shown in FIG. 24, the magnitude of the aerodynamic coefficient is substantially lower and more consistent between orientations for a golf ball of the present invention as compared to a prior art golf ball throughout the range of $N_{Re}$ tested. FIG. 25 illustrates that the angle of the aerodynamic force is more consistent for a golf ball of the present invention as compared to a prior art golf ball.

Golf balls may also be designed to fit the aerodynamic criteria of Table 9 by creating dimple patterns wherein all dimples have fixed radii and depth, but vary as to shape. For example, dimple shape variations may be defined as edge radius and edge angle or by catenary shape factor and edge radius. In one embodiment, a golf ball of the present invention meets the criteria of Table 9 by including dimples defined by the revolution of a catenary curve about an axis.

A catenary curve represents the curve formed by a perfectly flexible, uniformly dense, and inextensible cable suspended from its endpoints. In general, the mathematical formula representing such a curve is expressed as Equation 11:

$$y=\alpha \cosh(bx) \quad \text{(Eq. 11)}$$

where $\alpha$=constant
b=constant
y=vertical axis (on a two dimensional graph)
x=horizontal axis (on a two dimensional graph)

The dimple shape on the golf ball is generated by revolving the catenary curve about its y axis.

This embodiment uses variations of Equation 11 to define the cross-section of golf ball dimples. For example, the catenary curve is defined by hyperbolic sine or cosine functions. A hyperbolic sine function is expressed as Equation 12 below:

$$\sinh(x)=(e^{x}-e^{-x})/2 \quad \text{(Eq. 12)}$$

while a hyperbolic cosine function is expressed by Equation 13:

$$\cosh(x)=(c^{x}+e^{-x})/2 \quad \text{(Eq. 13)}$$

In one embodiment, the mathematical equation for describing the cross-sectional profile of a dimple is expressed by Equation 14:

$$Y=(d(\cosh(ax)-1))/(\cosh(ar)-1) \quad \text{(Eq. 14)}$$

where Y=vertical distance from the dimple apex
x=radial distance from the dimple apex to the dimple surface
$\alpha$=shape constant (shape factor)
d=depth of dimple
r=radius of dimple The "shape constant" or "shape factor", $\alpha$, is an independent variable in the mathematical expression for a catenary curve. The shape factor may be used to independently alter the volume ratio of the dimple while holding the dimple depth and radius fixed. The volume ratio is the fractional ratio of the dimple volume divided by the volume of a cylinder defined by a similar radius and depth as the dimple.

Use of the shape factor provides an expedient method of generating alternative dimple profiles, for dimples with fixed radii and depth. For example, to design a golf ball with lift and drag characteristics to fit the aerodynamic criteria of Table 9, alternative shape factors may be employed to obtain alternative lift and drag performance without having to change dimple pattern, depth or size. No modification to the dimple layout on the surface of the ball is required.

Figure 26:
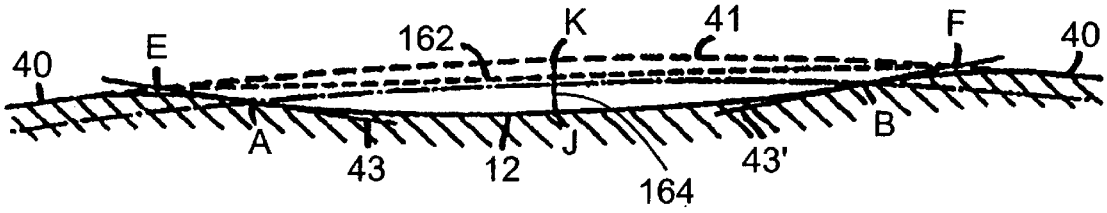
FIG. 26 shows a method for measuring the depth and radius of a dimple.

The depth (d) and radius (r) (r=½D) of the dimple may be measured as described in U.S. Pat. No. 4,729,861 (shown in FIG. 26), the disclosure of which is incorporated by reference in its entirety. The dimple diameter is measured from the edges of the dimples, points E and F, along straight line 162. Point J is the deepest part of the dimple 12. The depth is measured from point K on the continuation of the periphery 41 to point J and is indicated by line 164. Line 164 is perpendicular to line 162.

Figure 27:
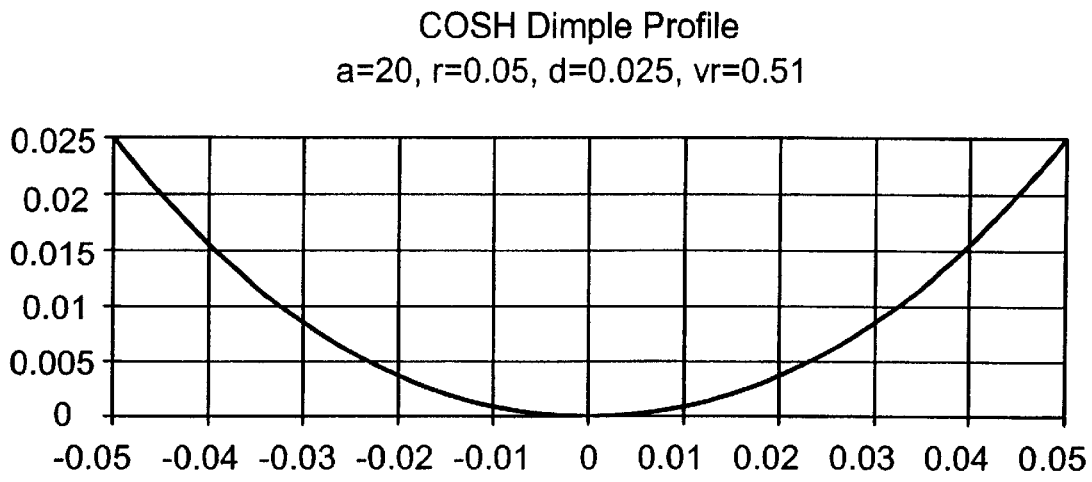
FIG. 27 is a dimple cross-sectional profile defined by a hyperbolic cosine function, cosh, with a shape constant of 20, a dimple depth of 0.025 inches, a dimple radius of 0.05 inches, and a volume ratio of 0.51.
Figure 28:
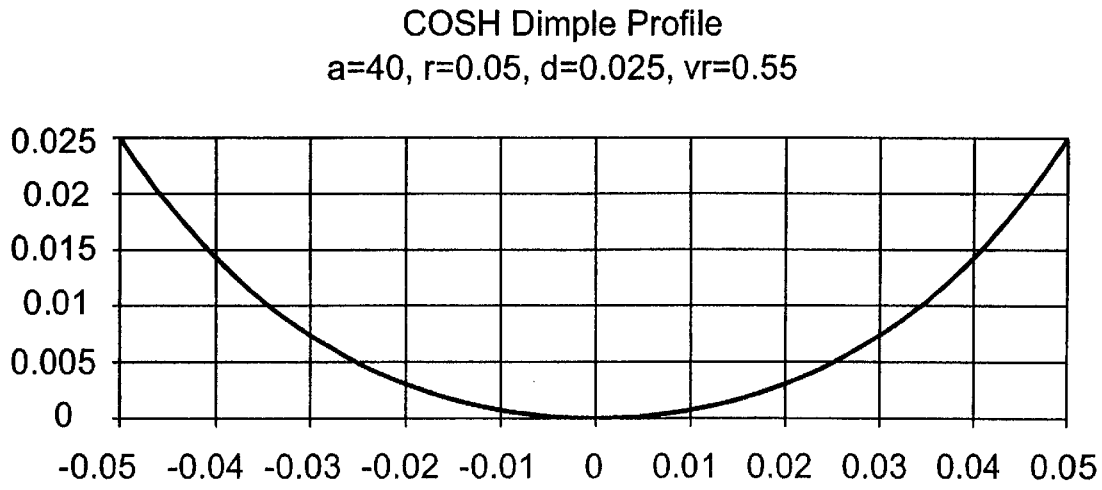
FIG. 28 is a dimple cross-sectional profile defined by a hyperbolic cosine function, cosh, with a shape constant of 40, a dimple depth of 0.025 inches, a dimple radius of 0.05 inches, and a volume ratio of 0.55.
Figure 29:
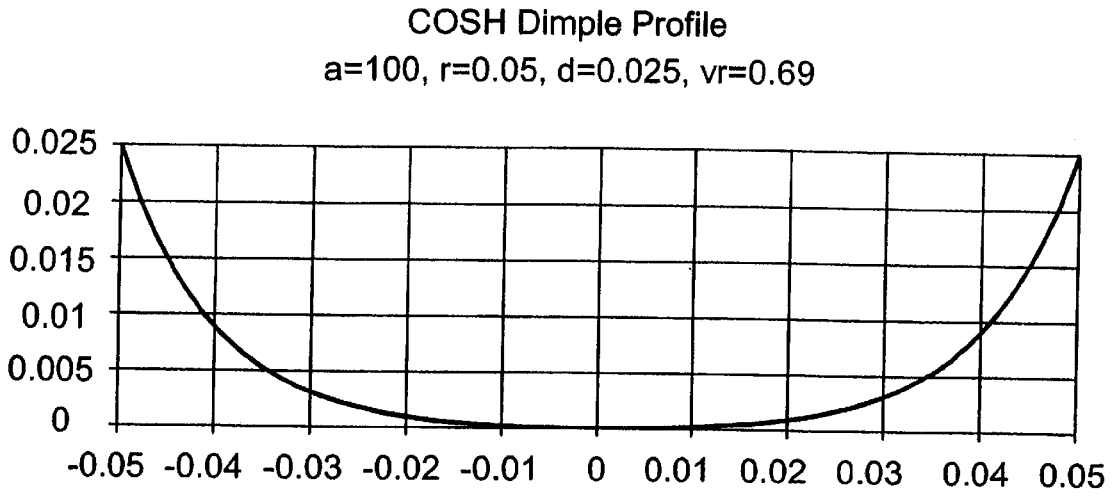
FIG. 29 is a dimple cross-sectional profile defined by a hyperbolic cosine function, cosh, with a shape constant of 100, a dimple depth of 0.025 inches, a dimple radius of 0.05 inches, and a volume ratio of 0.69.

For Equation 14, shape constant values that are larger than 1 result in dimple volume ratios greater than 0.5. In one embodiment, shape factors are between about 20 to about 100. FIGS. 27–29 illustrate dimple profiles for shape factors of 20, 40, and 100, respectively. Table 14 illustrates how the volume ratio changes for a dimple with a radius of 0.05 inches and a depth of 0.025 inches. Increases in shape factor result in higher volume ratios for a given dimple radius and depth. It has been discovered that the use of dimples with multiple catenary shape factors may be used to obtain the aerodynamic criteria of Table 9 and the symmetry requirements of less than 6 percent variation $C_{mag}$.

TABLE 14

Volume Ratio as a Function of Radius and Depth

| Shape Factor | Volume Ratio |
|---|---|
| 20 | 0.51 |
| 40 | 0.55 |
| 60 | 0.60 |
| 80 | 0.64 |
| 100 | 0.69 |

A dimple whose profile is defined by the cosh catenary curve with a shape constant of less than about 40 will have a smaller dimple volume than a dimple with a spherical profile. This will result in a larger aerodynamic force angle and higher trajectory. On the other hand, a dimple whose profile is defined by the cosh catenary curve with a shape constant of greater than about 40 will have a larger dimple volume than a dimple with a spherical profile. This will result in a smaller angle of the aerodynamic force and a lower trajectory. Therefore, a golf ball having dimples defined by a catenary curve with a shape constant is advantageous because the shape constant may be selected to obtain the aerodynamic criteria delineated in Table 9.

While this embodiment is directed toward using a catenary curve for at least one dimple on a golf ball, it is not necessary that catenary curves be used on every dimple on a golf ball. In some cases, the use of a catenary curve may only be used for a small number of dimples. It is preferred, however, that a sufficient number of dimples on the ball have catenary curves so that variation of shape factors will allow a designer to alter the aerodynamic characteristics of the ball to satisfy the aerodynamic criteria of Table 9. In one embodiment, the golf ball has at least about 10 percent, and more preferably at least about 60 percent, of its dimples defined by a catenary curves.

Moreover, it is not necessary that every dimple have the same shape factor. Instead, differing combinations of shape factors for different dimples on the ball may be used to achieve desired ball flight performance. For example, some of the dimples defined by catenary curves on a golf ball may have one shape factor while others have a different shape factor. In addition, the use of differing shape factors may be used for different diameter dimples, as described above in FIGS. 8–15.

Therefore, once a dimple pattern is selected for the golf ball, alternative shape factors for the catenary profile can be tested in light gate test range, as described in US 6,186,002, to empirically determine the catenary shape factor that provides the desired aerodynamic characteristics of Table 9.

Ball Selection Based on COR

Coefficient of restitution (COR) of the ball is also useful in matching a particular golfer with a specific club and ball because COR affects ball flight and total travel distance. COR can be measured for the club alone as discussed above (FIG. 4), the ball alone, or a combination of the club and ball together and considered when selecting a golf club and golf ball. In one embodiment, both the club COR and the ball COR are maximized when selecting the appropriate equipment for a golfer.

Ball COR is obtained by dividing a ball's rebound velocity by its initial (incoming) velocity. In the past, ball COR has been measured at an impact velocity of about 125 feet per second. U.S. Pat. No. 6,124,389, which is incorporated herein by reference in its entirety, shows that the COR of golf balls taken under these conditions ranges from about 0.800 to about 0.820. It should be noted, however, that the COR of a golf ball is a function of the golf ball impact velocity. In general, ball COR tends to decrease as ball impact speed increases. For example, a golf balls normally having COR values of about 0.800 and greater when measured at 125 ft/s initial velocity may have COR values as low as about 0.780 to about 0.790 when measured at an impact velocity of 150 ft/s. Thus, a higher COR dissipates a smaller fraction of total energy when the ball collides with and rebounds from the club face, while a lower COR dissipates a larger fraction of energy. As such, it follows that an increase in COR will generally result in an increase in ball flight distance and the maximum total travel distance of the golf ball. Further discussion of methods of measuring ball COR can be found in commonly assigned U.S. patent application Ser. No. 09/955,124 entitled "Apparatus and Method for Measurement of Coefficient of Restitution and Contact time," which is incorporated herein by reference in its entirety.

Launch Angle and Ball Spin

In addition to the club and ball characteristics discussed above, various club and ball characteristics can be combined to further optimize equipment selection. For example, as discussed above with respect to FIG. 5, a ball may be selected from a plurality of balls based on a direct linear relationship between the swing characteristic and ball weight and ball spin. In addition, FIG. 6 aided in demonstrating how golf ball spin may be selected using a predetermined relationship between the golf ball compression and the golfer's swing speed.

After achieving the optimum energy transfer from club head to ball (COR), it is preferred that the combination of optimum launch angle and optimum ball spin are determined to further achieve maximum distance. The launch angle and ball spin are determined in part from the club head loft angle and the location of the center of gravity of the club head relative to the center of gravity of the ball during impact. Other factors include the aerodynamic properties of the golf ball discussed above, such as its coefficients of lift and drag, and other physical properties of the ball. Preferably, all of these factors are considered in order to maximize distance.

Table 14 provides typical launch conditions for low, medium and high swing speed players versus the optimum conditions for driving performance. The table also illustrates that significant advances can be obtained by properly fitting a golfer to equipment based on a swing speed measurement.

TABLE 14

Typical and Optimum Launch Conditions

| | Typical | | Optimum | | Increase |
|---|---|---|---|---|---|
| Swing Speed | Launch Angle (degrees) | Spin Rate (rpm) | Launch Angle (degrees) | Spin Rate (rpm) | in Drive Distance (yards) |
| Low | 14–16 | 2800–3200 | 25–32 | 2900–3300 | 13–15 |
| Medium | 10–14 | 3300–3500 | 22–28 | 2600–2900 | 12–13 |
| High | 6–10 | 3200–3500 | 15–22 | 2400–2700 | 13–16 |

Since a change in launch conditions can significantly increase driving distance, it is advantageous to measure a player's playing characteristic and select club and ball properties to assist the player's game.

Computerized System

The methods of matching golfers with the optimum club, ball, or a combination thereof, may be incorporated into a computerized system so that the methods may be portably employed. For example, a golfer may be tested for swing speed using any of the swing analyzers discussed above while at a driving range. A computer algorithm may then be used to incorporate the swing speed results into the preexisting relationships set forth in FIGS. 2–7 and FIG. 19 to match a particular ball and/or club with the golfer's swing speed. In one embodiment, the swing speed analyzer and algorithm(s) are incorporated into a portable device of about 50 lbs. or less. In another embodiment, the portable device is about 25 lbs. or less. In yet another embodiment, the portable device is similar to a laptop computer with a weight of about 8 lbs. or less. In still another embodiment, the swing speed analyzer and algorithm(s) are incorporated into a portable device similar to a personal digital assistant (PDA), with a weight of about 1 lb. or less.

Club and Ball Construction

The present invention may be used with any type of club and ball construction. For example, the invention may be used to fit a golfer with a driver or an iron. In addition, the invention may be used with differing types of irons, e.g., muscle back, cavity back, and forged.

The ball may have a 1-piece design, a 2-piece design, a three-piece design, a double core, a double cover, or multi-core and multi-cover construction depending on the type of performance desired of the ball. Non-limiting examples of these and other types of ball constructions that may be used with the present invention include those described in U.S. Pat. Nos. 5,688,191, 5,713,801, 5,803,831, 5,885,172, 5,919,100, 5,965,669, 5,981,654, 5,981,658, and 6,149,535, as well as in Publication Ser. No. U.S. 2001/0009310 A1. The entire disclosures of these applications are incorporated by reference herein.

Different materials also may be used in the construction of the golf balls made with the present invention. For example, the cover of the ball may be made of a thermoset or thermoplastic, a castable or non-castable polyurethane and polyurea, an ionomer resin, balata, or any other suitable cover material known to those skilled in the art. Different materials also may be used for forming core and intermediate layers of the ball. For example, golf balls having solid, wound, liquid filled, dual cores, and multi-layer intermediate components are contemplated by the invention. For example, the most common core material is polybutadiene, although one of ordinary skill in the art is aware of the various materials that may be used with the present invention. After selecting the desired ball construction, the aerodynamic performance of the golf ball designed to satisfy the aerodynamic criteria outlined in Table 1 according to the design, placement, and number of dimples on the ball.

As explained above, the use of various dimple patterns and profiles provides a relatively effective way to modify the aerodynamic characteristics. The use of the catenary curve profile allows a golf ball design to meet the aerodynamic criteria of Table 1 without significantly altering the dimple pattern. Different materials and ball constructions can also be selected to achieve a desired performance.

EXAMPLES

The following non-limiting examples are merely illustrative of the preferred embodiments of the present invention, and are not to be construed as limiting the invention, the scope of which is defined by the appended claims. Parts are by weight unless otherwise indicated.

Example 1

Consider an average handicap player (i.e., 12–18) with a measured club head speed of 80 miles per hour, which would characterize this golfer under the present invention as having a medium swing speed. Using FIG. 2, it can be seen that such a golfer should be matched with a club having a loft angle between 90 and 150 and more preferably to a driver having a loft of about 12°. Moreover, the golfer should be fitted to either a R or S shaft flex to obtain optimum driving performance. Most preferably, the golfer would be fitted to the R shaft flex using FIG. 2. As illustrated in FIG. 3, the average club face thickness corresponding to the player of this example would be about 0.09 to about 0.10 inches.

Once the proper club is selected, the next step is to match the golfer to a desired weight golf ball and a spin rate as set forth in FIG. 5. As shown in FIG. 5, it is preferred that the golfer in this example use a ball having a weight between about 1.56 and 1.61, and a spin rate from about 2900 to about 3400. More particularly, the golfer can be fitted to a ball having a weight of about 1.58 ounces and a spin rate of about 3000 when hit by a True Temper machine under USGA standards.

Alternatively, the ball can be selected based on its compression. As shown in FIG. 6, it is preferred that the golfer in this example use a ball having a compression between about 65 and about 95, and a spin rate from about 2900 to about 3400. More particularly, the golfer can be fitted to a ball having a compression of about 80 Atti and a spin rate of about 3000 when hit by a True Temper machine under USGA standards. However, it should be noted that for different golf club constructions and different golf ball constructions, these recommended lofts, flexes, ball weights, ball compressions, and ball spin rates may vary, as discussed above.

Example 2

Now consider a senior golfer whose measured club head speed is 55 miles per hour, which is a low club head speed under the present invention. FIG. 2 demonstrates that such a golfer should be matched to a driver with a loft angle between 12° and 18° and either an A or R shaft flex to achieve maximum driving distance. Preferably, the golfer is matched to a 15° driver with a flex as shown by FIG. 2. As shown in FIG. 3, the average club face thickness of the club should be between about 0.07 to about 0.08 inches.

Next, the golfer should be matched to a golf ball having a low weight and high spin. More specifically, as shown in FIG. 5, the golfer should use a low weight ball of about 1.56 oz. And have a ball with a spin rate of greater than 3500 rpm when hit with a True Temper machine according to USGA standards.

Alternatively, the ball can be selected based on its compression. It is preferred that the golfer in this example use a ball having a low compression and high spin. As shown in FIG. 6, the golfer should use a low compression ball of about 65 Atti and have a ball with a spin rate of greater than 3500 rpm when hit with a True Temper machine according to USGA standards.

While it is apparent that the illustrative embodiments of the invention herein disclosed fulfill the objectives stated above, it will be appreciated that numerous modifications and other embodiments. For example, golf balls having tetrahedron dimple arrangements (four triangles) may be used with the present invention. In addition, the present invention may be used for golfers of all skill levels, although some of the embodiments described herein are directed to medium to high handicap golfers. Also, as discussed throughout, matching a golfer with a golf ball or golf club may also be determined using ball speed instead of club head (swing) speed. Therefore, it will be understood that the appended claims are intended to cover all such modifications and embodiments which come within the spirit and scope of the present invention.

What is claimed is:

1. A method for matching a golfer to a golf ball and a golf club comprising the steps of:

measuring at least one parameter for the golfer at impact with a ball, wherein the at least one parameter comprises club head speed, ball speed, or a combination thereof, comparing the measured parameter to a predetermined set of variables, wherein the set of variables comprise:
golf club loft angle;
golf club coefficient of restitution;
golf ball dimple count; and
golf ball dimple diameter;

selecting at least one golf club and at least one golf ball in accordance with the comparison of the club head speed to the set of variables to obtain optimum driving performance.

2. The method of claim 1, wherein the measured parameter is correlated to the golf club loft angle based on a linear relationship.

3. The method of claim 1, wherein the measured parameter is correlated to the golf club coefficient of restitution based on a linear relationship.

4. The method of claim 1, wherein the measured parameter is correlated to the dimple count based on a linear relationship.

5. The method of claim 1, wherein the measured parameter is correlated to the golf ball dimple diameter based on a linear relationship.

6. The method of claim 1, wherein the club head speed comprises high speed, medium speed, and low speed, and wherein high speed is about 80 miles per hour or greater, wherein the medium speed about 60 miles per hour to about 80 miles per hour and the low speed is about 60 miles per hour or less.

7. The method of claim 1, wherein the ball speed comprises high speed, medium speed, and low speed, and wherein high speed is about 146 miles per hour or greater, wherein the medium speed is about 144 miles per hour to about 125 miles per hour, and wherein the low ball speed is about 124 miles per hour or less.

8. The method of claim 1, wherein the set of variables further comprises average golf club face thickness, golf club shaft flex, ball weight, ball spin rate, ball compression, lift coefficient, or drag coefficient, wherein the lift coefficient and drag coefficient are measured at a Reynold's number of 70,000.

9. A method for matching a golfer to a golf ball comprising a plurality of dimples and a golf club comprising the steps of:

measuring at least one golfer parameter, wherein the at least one parameter comprises swing speed or ball speed;

comparing the measured parameter to at least one predetermined club characteristic comprising club coefficient of restitution, loft angle, shaft flex, or club face thickness and at least one predetermined ball characteristic comprising dimple count, average dimple diameter, ball coefficient of restitution, spin rate, compression, golf ball lift coefficient, or golf ball drag coefficient; and matching the golfer to at least one golf club and at least one golf ball in accordance with the comparison of the measured parameter to the at least one predetermined club characteristic or the at least one predetermined ball characteristic to obtain optimum driving performance.

10. The method of claim 9, wherein the measured parameter is correlated to the at least one predetermined club characteristic based on a linear relationship.

11. The method of claim 9, wherein the measured parameter is correlated to the at least one predetermined ball characteristic based on a linear relationship.

12. The method of claim 9, wherein the ball speed comprises high speed, medium speed, and low speed, and wherein high speed is about 146 miles per hour or greater, wherein the medium speed is about 144 miles per hour to about 125 miles per hour, and wherein the low ball speed is about 124 miles per hour or less.

13. The method of claim 9, wherein the lift and drag coefficients are measured at a Reynold's Number of 70,000.

14. The method of claim 9, wherein the plurality of dimples cover about 80 percent or greater of the ball surface.

15. The method of claim 9, wherein at least about 80 percent of the plurality of dimples have a diameter greater than about 6.5 percent of the ball diameter, and wherein the dimples are arranged in an icosahedron or an octahedron pattern.

16. The method of claim 9, wherein the plurality of dimples comprises at least three different dimple diameters.

17. The method of claim 9, wherein at least 10 percent of the dimples have a shape defined by catenary curve.

18. The method of claim 9, wherein the plurality of dimples have an aerodynamic coefficient magnitude defined by $C_{mag}=\sqrt{(C_L^2+C_D^2)}$ and an aerodynamic force angle defined by $\text{Angle}=\tan^{-1}(C_L C_D)$, wherein $C_L$ is the golf ball lift coefficient and $C_D$ is the golf ball drag coefficient, wherein the golf ball comprises:

a first aerodynamic coefficient magnitude from about 0.24 to about 0.27 and a first aerodynamic force angle of about 31 degrees to about 35 degrees at a Reynolds Number of about 230000 and a spin ratio of about 0.085; and a second aerodynamic coefficient magnitude from about 0.25 to about 0.28 and a second aerodynamic force angle of about 34 degrees to about 38 degrees at a Reynolds Number of about 207000 and a spin ratio of about 0.095.

* * * * *